US008145369B1

(12) United States Patent
Tureaud et al.

(10) Patent No.: US 8,145,369 B1
(45) Date of Patent: Mar. 27, 2012

(54) DOCKING APPARATUSES AND METHODS

(75) Inventors: Thomas F. Tureaud, Fairfax, VA (US); Daniel N. Dietz, Alexandria, VA (US); Stacy J. Hills, Ashburn, VA (US); Douglas E. Humphreys, Great Falls, VA (US); Alexander V. Roup, Sterling, VA (US)

(73) Assignee: Vehicle Control Technologies, Inc., Reston, VA (US)

( * ) Notice: Subject to any disclaimer, the term of this patent is extended or adjusted under 35 U.S.C. 154(b) by 1157 days.

(21) Appl. No.: 11/982,041

(22) Filed: Nov. 1, 2007

(51) Int. Cl.
*B63H 19/00* (2006.01)

(52) U.S. Cl. ..... 701/21; 701/1

(58) Field of Classification Search ..... 701/1, 21; 73/118.01, 118.04; 440/33–36; 414/139.2, 414/137.9

See application file for complete search history.

(56) References Cited

U.S. PATENT DOCUMENTS

| | | | | |
|---|---|---|---|---|
| 3,466,798 | A | 9/1969 | Speers et al. | |
| D217,744 | S | 6/1970 | Peterson et al. | |
| 3,647,253 | A | 3/1972 | Hettinger et al. | |
| 3,650,234 | A | 3/1972 | Goudy | |
| D242,615 | S | 12/1976 | Henning | |
| 4,391,423 | A * | 7/1983 | Pruett et al. | 244/172.4 |
| D290,108 | S | 6/1987 | Wolfe | |
| D291,299 | S | 8/1987 | Hawkes | |
| 4,705,331 | A | 11/1987 | Britton | |
| D304,923 | S | 12/1989 | Pado | |
| D308,851 | S | 6/1990 | Templeman | |
| 5,048,449 | A | 9/1991 | Templeman | |
| D323,808 | S | 2/1992 | DeSantis | |
| 5,120,099 | A | 6/1992 | Fletcher | |
| D328,732 | S | 8/1992 | Whitley, II | |
| 5,138,966 | A | 8/1992 | Whitley, II | |
| 5,158,034 | A | 10/1992 | Hsu | |
| D331,738 | S | 12/1992 | Simpson | |
| 5,307,754 | A | 5/1994 | Leonardis | |
| D350,326 | S | 9/1994 | Grifflin | |
| D352,023 | S | 11/1994 | Corn | |
| 5,396,860 | A | 3/1995 | Cheng | |
| D363,914 | S | 11/1995 | Corn | |
| D371,411 | S | 7/1996 | Albritton | |
| 5,568,783 | A | 10/1996 | Ditchfield | |
| 5,655,939 | A | 8/1997 | Garrido Salvadores | |
| 5,686,694 | A | 11/1997 | Hillenbrand et al. | |
| 5,704,817 | A | 1/1998 | Vaughn | |
| D390,618 | S | 2/1998 | Wilson | |
| 5,713,293 | A | 2/1998 | Shiffler et al. | |
| D394,633 | S | 5/1998 | Gauthier et al. | |
| 5,786,545 | A | 7/1998 | Hillenbrand | |
| D400,624 | S | 11/1998 | Hornsby et al. | |

(Continued)

OTHER PUBLICATIONS

Bondaryk et al. (presumably), "Automated Launch and Recovery of UUVs and Towed Assets from USSV", date is before Nov. 1, 2007, pp. 1-5/Frames 1-20, Brooke Ocean Technology Ltd.

(Continued)

*Primary Examiner* — Yonel Beaulieu
(74) *Attorney, Agent, or Firm* — Womble Carlyle Sandridge & Rice, LLP

(57) ABSTRACT

An intercepting vehicle, which is being towed by a towing vehicle, may home in on and attach to a retrievable vehicle that catches up to the intercepting vehicle from behind. Then, the intercepting vehicle, with the retrievable vehicle docked thereto, may be brought to the towing vehicle by reeling in the intercepting vehicle with the retrievable vehicle docked thereto.

56 Claims, 27 Drawing Sheets

U.S. PATENT DOCUMENTS

| | | | |
|---|---|---|---|
| 5,970,546 | A | 10/1999 | Danis |
| D440,619 | S | 4/2001 | Chiang |
| 6,359,834 | B1 | 3/2002 | English |
| 6,390,012 | B1 | 5/2002 | Watt et al. |
| D466,175 | S | 11/2002 | Katz et al. |
| 6,600,695 | B1 | 7/2003 | Nugent et al. |
| D487,245 | S | 3/2004 | Geriene et al. |
| 6,738,314 | B1 | 5/2004 | Teeter et al. |
| D492,242 | S | 6/2004 | Geriene et al. |
| 6,766,745 | B1 | 7/2004 | Kuklinski et al. |
| 6,779,475 | B1 | 8/2004 | Crane et al. |
| 6,854,410 | B1 | 2/2005 | King et al. |
| D505,104 | S | 5/2005 | Osumi et al. |
| 6,969,030 | B1 | 11/2005 | Jones et al. |
| 7,000,560 | B2 | 2/2006 | Wingett et al. |
| 7,010,401 | B1 | 3/2006 | Richburg et al. |
| 7,021,231 | B2 | 4/2006 | Smart |
| 7,051,664 | B2 | 5/2006 | Robichaud et al. |
| 7,104,505 | B2 | 9/2006 | Tchoryk et al. |
| D533,497 | S | 12/2006 | Templeman |
| 7,156,036 | B2 | 1/2007 | Seiple |
| D537,142 | S | 2/2007 | Eagan |
| D549,297 | S | 8/2007 | Eagan |
| D560,264 | S | 1/2008 | Nakpodia |
| D573,220 | S | 7/2008 | Nakpodia |
| 2001/0025594 | A1 | 10/2001 | Daniels |
| 2002/0152945 | A1 | 10/2002 | Geriene et al. |

OTHER PUBLICATIONS

U.S. Appl. No. 29/292,923, filed Nov. 1, 2007; In re: Thomas F. Tureaud et al., entitled "Underwater Vehicle".

U.S. Appl. No. 29/292,925, filed Nov. 1, 2007; In re: Thomas F. Tureaud et al., entitled "Underwater Vehicle".

U.S. Appl. No. 29/292,924, filed Nov. 1, 2007; In re: Thomas F. Tureaud et al., entitled "Portion of a Vehicle".

U.S. Appl. No. 29/292,926, filed Nov. 1, 2007; In re: Thomas F. Tureaud et al., entitled "Docking Slot Portion of an Object".

Notice of Allowability for U.S. Appl. No. 29/292,923, filed Nov. 1, 2007; In re: Tureaud et al., entitled Underwater Vehicle.

Notice of Allowability for U.S. Appl. No. 29/292,925, filed Nov. 1, 2007; In re: Tureaud et al., entitled Underwater Vehicle.

Notice of Allowability for U.S. Appl. No. 29/292,924, filed Nov. 1, 2007; In re: Tureaud et al., entitled Portion of a Vehicle.

Notice of Allowability for U.S. Appl. No. 29/292,926, filed Nov. 1, 2007; In re: Tureaud et al., entitled Docking Slot Portion of an Object.

U.S. Appl. No. 12/231,238, filed Aug. 29, 2008; In re: Douglas Humphreys et al., entitled Self-Propelled Tow Body.

* cited by examiner

DOCKING APPARATUSES AND METHODS

STATEMENT OF GOVERNMENT SUPPORT

The present invention was made with Government support under Small Business Innovation Research (SBIR) Program Contract No. N00024-06-C-4134 awarded by the United States Navy. The Government has certain rights in the invention.

TECHNICAL FIELD

The present application generally relates to docking a vehicle and, more particularly, to docking a moving vehicle to another moving vehicle, such as for purposes of retrieval.

BACKGROUND OF THE INVENTION

A variety of systems are known for docking one vehicle to another vehicle, and for using a vehicle to retrieve another vehicle. For example, it is known to use a submarine in the process of capturing and retrieving an unmanned underwater vehicle. As another example, it is known to maneuver a tethered submersible vehicle to another underwater vehicle, connect the tethered submersible vehicle to the other underwater vehicle, and then retrieve the tethered submersible vehicle and the other underwater vehicle to a boat.

There is a desire for docking apparatuses and methods that provide a new balance of properties.

BRIEF SUMMARY OF SOME ASPECTS OF THE INVENTION

In accordance with one aspect of the present invention, an intercepting vehicle, which is being towed by a towing vehicle, may home in on and attach to a retrievable vehicle that catches up to the intercepting vehicle from behind. Then, the intercepting vehicle, with the retrievable vehicle docked thereto, may be brought to the towing vehicle by reeling in the intercepting vehicle with the retrievable vehicle docked thereto. The path of the towing vehicle may be at least generally aligned with the path of the retrievable vehicle, in order to enable the path of the intercepting vehicle, which is at least somewhat constrained by the towing, to become substantially aligned with the path of the retrievable vehicle. Typically the path of the retrievable vehicle is not adjusted while the intercepting vehicle homes in on the retrievable vehicle (e.g., operation of the retrievable vehicle may remain, and typically does remain, steady state while it is being homed in on). Alternatively, the path and/or other operating characteristics of the retrievable vehicle may be adjusted while it is being homed in on.

In accordance with a first embodiment of the present invention, the towing vehicle is a boat, and each of the intercepting vehicle and the retrievable vehicle is an unmanned underwater vehicle. The boat may be manned (e.g., directly controlled), remotely controlled and/or automatically controlled. Alternatively, one or more of, or all of, the vehicles may be aircrafts and/or other types of vehicles.

Other aspects and advantages of the present invention will become apparent from the following.

BRIEF DESCRIPTION OF THE DRAWINGS

Having described some aspects of the invention in general terms, reference is made in the following to the accompanying drawings, which are not necessarily drawn to scale and are briefly described in the following.

DETAILED DESCRIPTION

Figure 1:
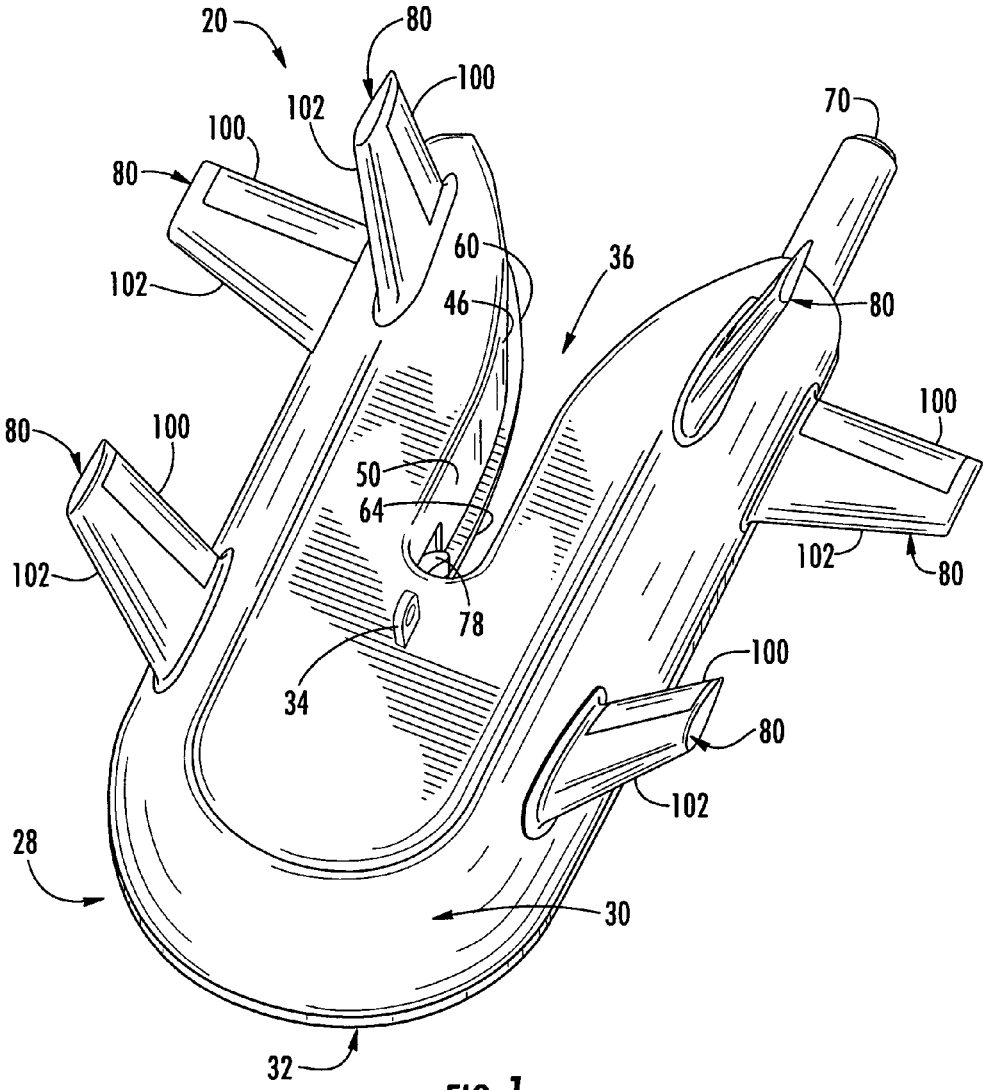
FIG. 1 is a top/front perspective view of an unmanned underwater vehicle (e.g., intercepting vehicle) that may be towed and used for intercepting, docking and retrieving, in accordance with a first embodiment of the present invention.

Referring now in greater detail to the drawings, in which like numerals refer to like parts throughout the several views, exemplary embodiments of the present invention are described in the following. Very generally described in accordance with a first embodiment of the present invention, and as best understood with reference to FIG. 12, an intercepting vehicle 20, which is being towed by a towing vehicle 22 by way of a tow line 24, may home in on and attach to/dock to a retrievable vehicle 26 that catches up to the intercepting vehicle 20 from behind. Then, the intercepting vehicle 20, with the retrievable vehicle 26 docked thereto, may be brought to the towing vehicle 22 by reeling in the tow line 24.

FIGS. 1-7 illustrate the intercepting vehicle 20 in the form of an unmanned underwater vehicle that may be towed and used for intercepting, docking and retrieving, in accordance with the first embodiment of the present invention. The intercepting vehicle 20 may also be referred to, for example, as a drogue, tow-body, towed vehicle or homing vehicle. As best understood with reference to FIGS. 1-7, the intercepting vehicle 20 has a vehicle body 28. In accordance with the embodiments shown in the figures and as will be discussed in greater detail below, the vehicle body 28 includes an upper shell 30 that is mounted to a lower plate 32. The shell 30 defines (e.g., substantially defines) the top side of the vehicle body 28, and the lower plate 32 defines (e.g., substantially defines) the bottom side of the vehicle body 28.

As mentioned above and as will be discussed in greater detail below, the intercepting vehicle 20 may be towed by the tow line 24 (FIG. 12), or the like; therefore, the vehicle body 28 of the intercepting vehicle 20 typically includes an attachment mechanism for being attached to the tow line 24. In accordance with the first embodiment of the present invention, the attachment mechanism is in the form of a tow fitting 34 that is mounted to the top side of the shell 30. The tow fitting 34 typically includes an eyelet or other suitable structure for facilitating attachment of the tow line 24 to the tow fitting 34. The tow fitting 34 is typically mounted rearwardly of the front end of the vehicle body 28 and forwardly of a receptacle hole that is defined in the vehicle body 28 and may more specifically be in the form of a receptacle slot 36.

The receptacle slot 36 may be used in docking, as will be described far below, for example, with reference to FIGS. 20-22. The structure of the receptacle slot 36 is described in detail in the following with reference to FIGS. 1, 2 and 4-6, in accordance with the first embodiment of the present invention, although differently configured receptacle slots/holes are within the scope of the present invention. The receptacle slot 36 extends through the vehicle body 28 of the intercepting vehicle 20 (e.g., through each of the shell 30 and the lower plate 32) such that the receptacle slot 36 is open at each of the top, bottom and rear side of the vehicle body 28. In accordance with the first embodiment of the present invention, the thickness of the vehicle body 28 from its top to its bottom is smaller than both: the width of the vehicle body 28, which extends between the right and left sides of the vehicle body 28, and the length of the vehicle body 28, which extends between the front and rear ends of the vehicle body 28. Therefore, the right and left sides, and the front and rear ends of the vehicle body 28 may be referred to as peripheral portions of the vehicle body 28, and the receptacle slot 36 is open at the periphery of the vehicle body 28 by virtue of being open at the rear end of the vehicle body 28. The receptacle slot 36 is elongate and extends in a longitudinal direction, with the front and rear ends of the vehicle body 28 being spaced apart from one another in the longitudinal direction. The receptacle slot 36 has a width that extends crosswise with respect to the longitudinal direction, and the width is typically smaller than the length of the receptacle slot 36, with the width of the receptacle slot 36 becoming larger toward the rear end of the vehicle body 28.

The rear and somewhat central portions of the intercepting vehicle 20 are bifurcated by the receptacle slot 36. More specifically, the rear and somewhat central portions of the shell 30 are bifurcated by the receptacle slot 36. Even more specifically and as best understood with reference to FIGS. 2 and 4, the rear wall of the shell 30 is bifurcated into upright, right and left rear walls 40, 42. The receptacle slot 36 is partially defined by upright, right and left convex walls 44, 46 of the shell 30. Portions of the right and left convex walls 44, 46 are in opposing face-to-face relation with respect to one another. The right and left convex walls 44, 46 respectively extend forwardly from the right and left rear walls 40, 42, so that the right and left convex walls 44, 46 taper toward one another in the forward direction. The receptacle slot 36 is partially defined by upright, right and left straight walls 48, 50 (e.g., substantially straight walls) of the shell 30. The right and left straight walls 48, 50 are in opposing face-to-face relation with respect to one another and respectively extend forwardly from the right and left convex walls 44, 46. The receptacle slot 36 is partially defined by an upright, concave wall 52 of the shell 30. The right and left straight walls 48, 50 respectively extend rearwardly from opposite right and left ends of the concave wall 52.

Figure 2:
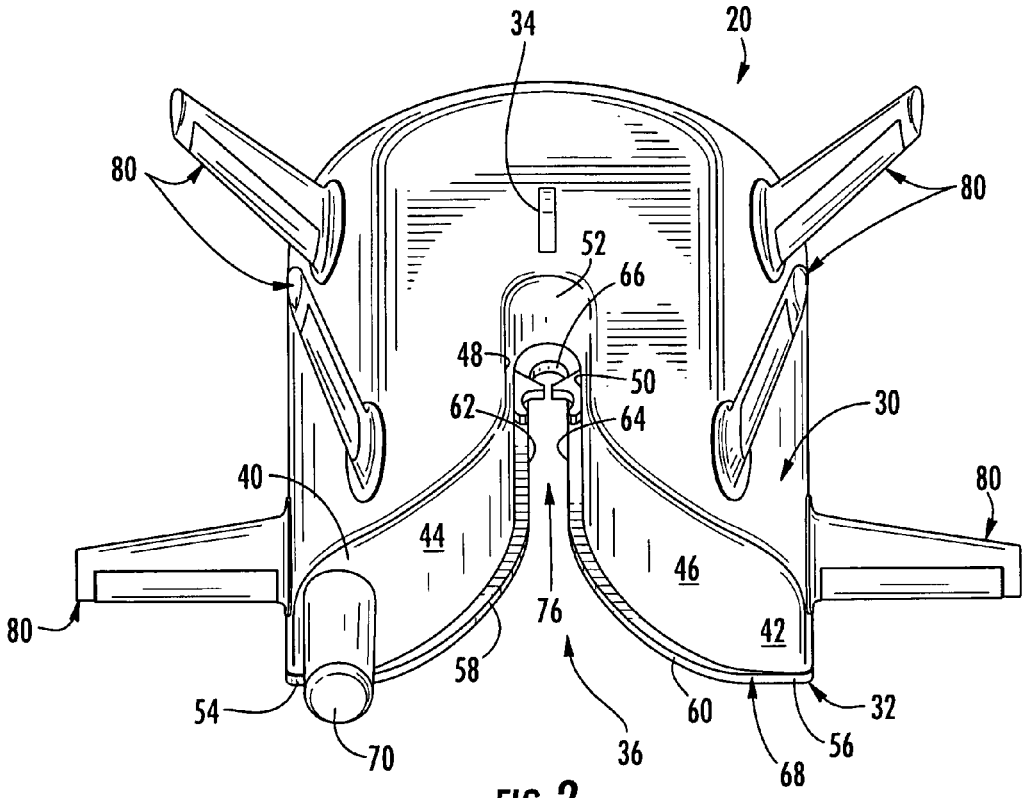
FIG. 2 is a rear/top perspective view of the vehicle of FIG. 1.
Figure 3:
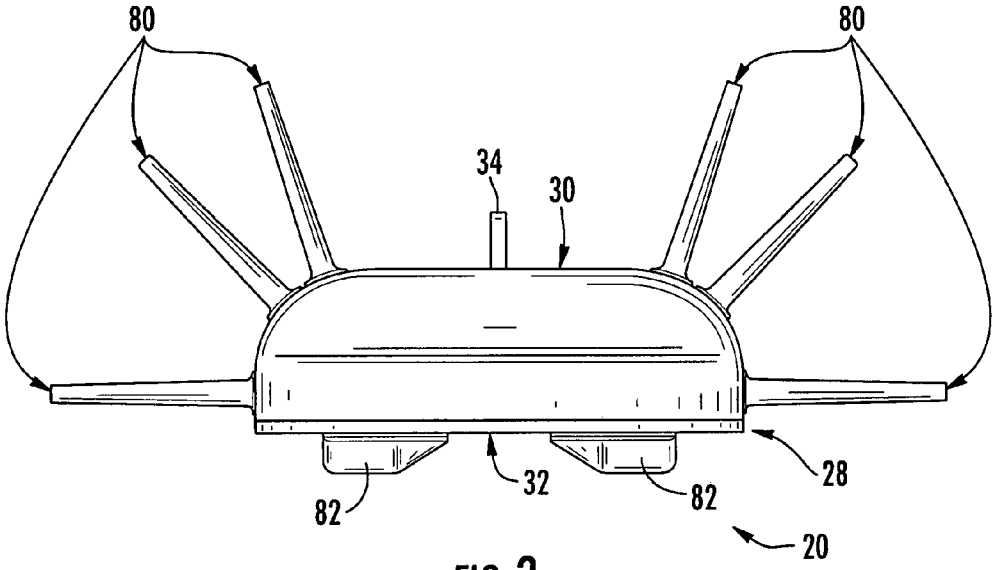
FIG. 3 is a front elevation view of the vehicle of FIG. 1.
Figure 4:
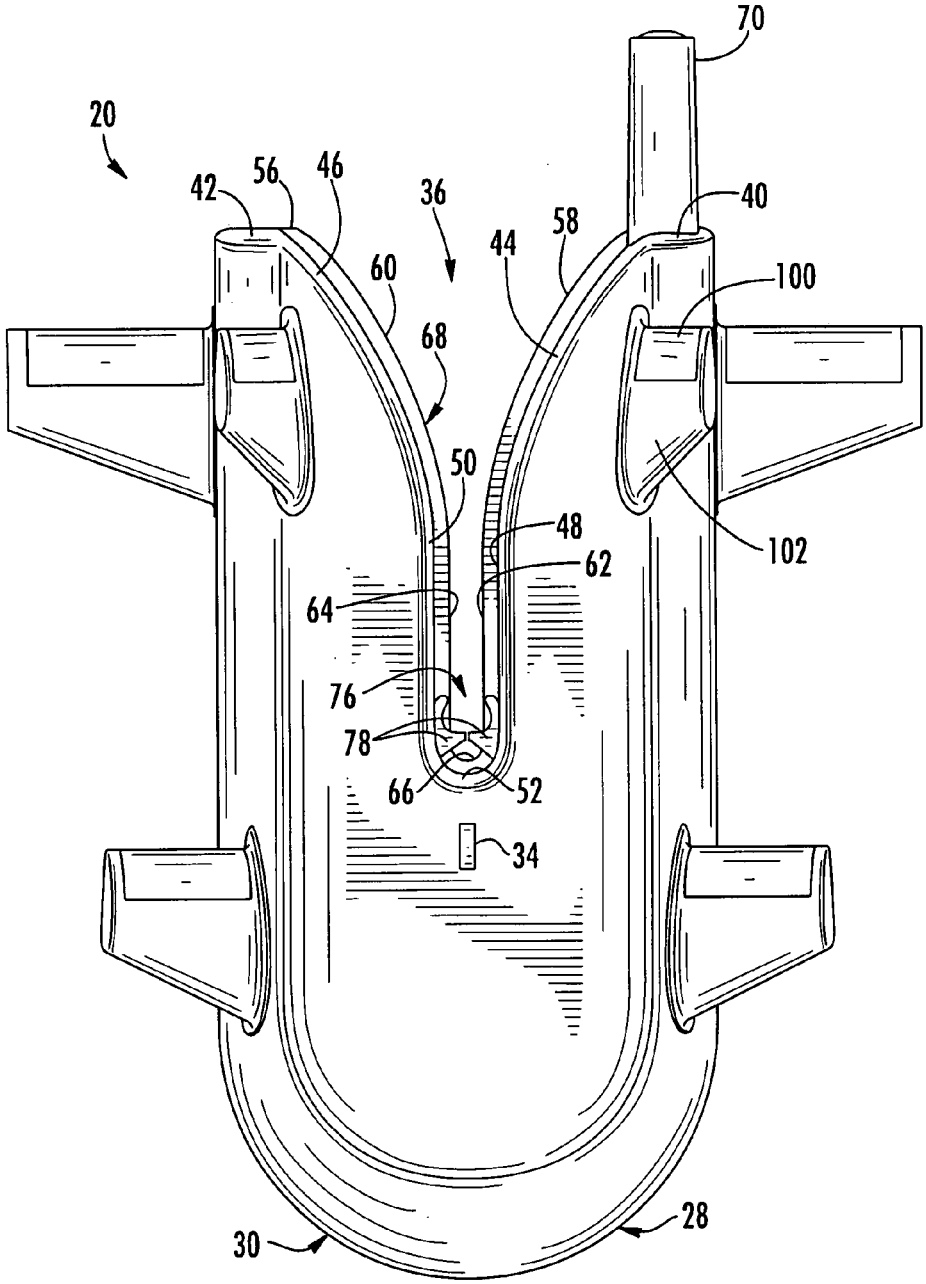
FIG. 4 is a top plan view of the vehicle of FIG. 1.
Figure 5:
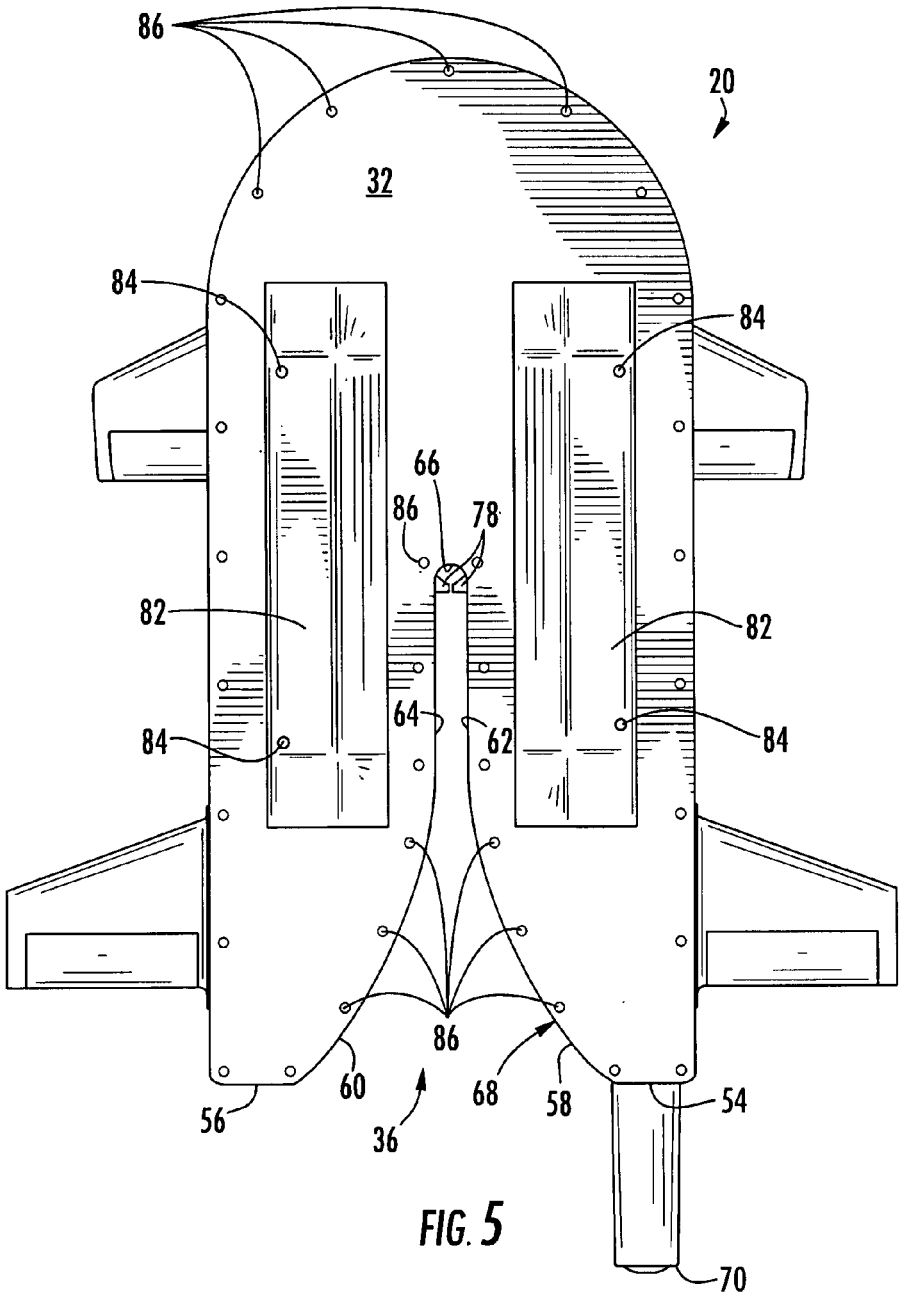
FIG. 5 is a bottom plan view of the vehicle of FIG. 1.
Figure 6:
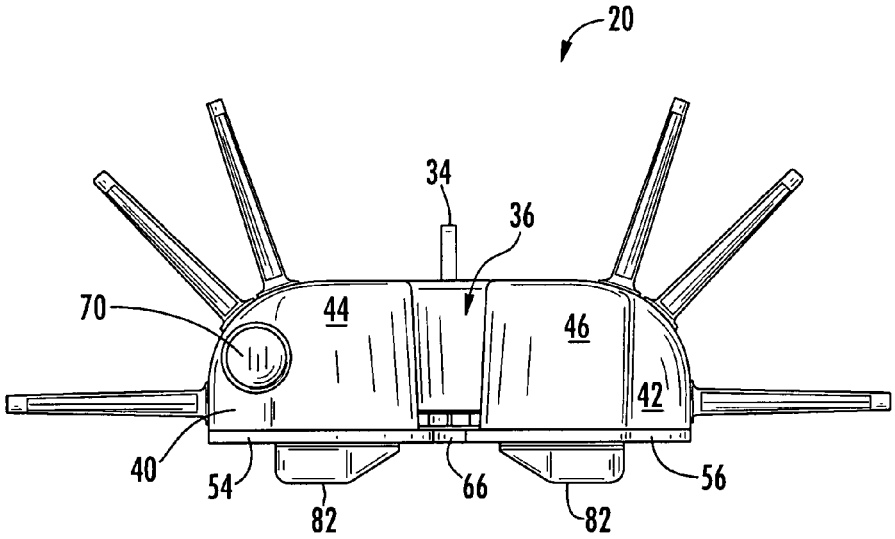
FIG. 6 is a rear elevation view of the vehicle of FIG. 1.
Figure 7:
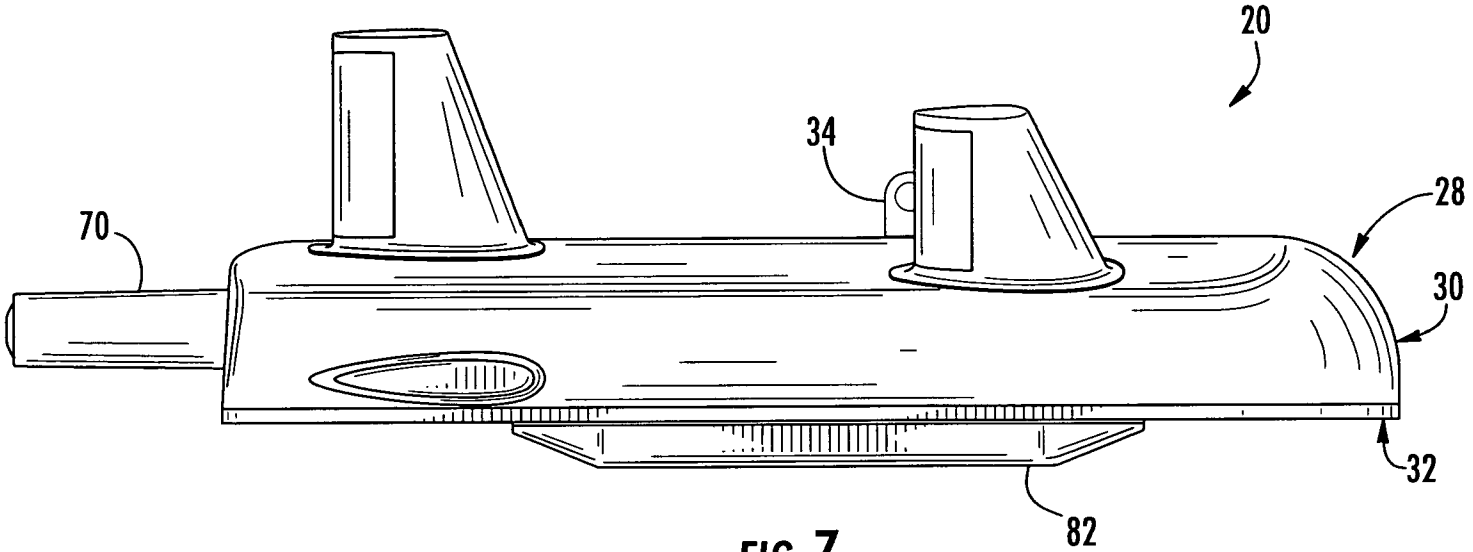
FIG. 7 is a left elevation view of the vehicle of FIG. 1, wherein a right elevation view of the vehicle of FIG. 1 is substantially a mirror image of FIG. 7.

Similarly and as best understood with reference to FIGS. 2, 4 and 5, the rear and somewhat central portions of the lower plate 32 are bifurcated by the receptacle slot 36. The edges of the lower plate 32 respectively include upright right rear, left rear, right convex, left convex, right straight, left straight and concave walls 54, 56, 58, 60, 62, 64, 66 that are respectively like the right rear, left rear, right convex, left convex, right straight, left straight and concave walls 40, 42, 44, 46, 48, 50, 52 of the shell 30, except for variations noted herein and variations that will be apparent to one of ordinary skill in the art. For example, the right convex, left convex, right straight, left straight and concave walls 58, 60, 62, 64, 66 of the lower plate 32 are positioned farther into the receptacle slot 36 than the right convex, left convex, right straight, left straight and concave walls 44, 46, 48, 50, 52 of the shell 30. More specifically, the right convex, left convex, right straight, left straight and concave walls 58, 60, 62, 64, 66 of the lower plate 32 are part of a docking flange 68 of the lower plate 32, and the docking flange 68 extends partially around (e.g., at least partially around) and protrudes into the receptacle slot 36 at the bottom side of the vehicle body 28, as will be discussed in greater detail below.

A transceiver housing 70 is mounted to either the right rear wall 40 or the left rear wall 42 of the shell 30. The transceiver housing 70 typically contains a homing transceiver 72 (FIG. 8), which is discussed in greater detail below. The transceiver housing 70 is shown in the drawings as being mounted to the right rear wall 40, although it could be mounted to the left rear wall 42 instead. Alternatively, there may be a second housing (e.g., transceiver housing 70) mounted to the rear wall 42 that does not include the other transceiver housing 70. As another alternative, the transceiver housing(s) 70 may be omitted, and the associated transceiver(s), or the like, may be mounted within the shell 30.

For docking purposes, a capturing mechanism extends into the forward portion of the receptacle slot 36 for grasping, or more specifically capturing, an object that becomes positioned within the forward portion of the receptacle slot 36, as will be discussed in greater detail below. In accordance with the first embodiment of the present invention, the capturing mechanism is a latch 76 (e.g., see FIGS. 2, 4 and 8) having pivotably mounted right and left clasps 78 (e.g., bear claw type latches). The clasps 78 are diametrically opposite from one another, in opposing face-to-face relation with respect to one another, and each extends into the receptacle slot 36 at a location that is proximate the forward end of the receptacle slot 36. The clasps 78 may respectively extend through openings in the straight and concave walls 48, 50, 52 of the shell 30. The clasps 78 are shown in an open configuration in FIGS. 1, 2, 4-6 and 20. In the open configuration, arms of the clasps 78 protrude into the receptacle slot 36. The capturing mechanism (e.g., latch 76) may be any type of mechanism that functions suitably for carrying out the grasping aspect of the present invention, which is described in greater detail below. For example, other types and arrangements of latch(es)/clasp(s) are within the scope of the present invention.

Six fin assemblies 80 are mounted to the shell 30 in pairs, although the number and arrangement of the fin assemblies may vary. In accordance with the first embodiment of the present invention, except for their arrangements, each of the fin assemblies 80 is identical; the shell 30 has mounting regions that are adapted for having the fin assemblies 80 respectively mounted thereto; each of the mounting regions is adapted for having any one of the fin assemblies 80 mounted thereto; and each of the fin assemblies 80 is adapted for being mounted to any one of the mounting regions. The fin assemblies 80 may be detached from vehicle body 28 for ease of transport or storage, and when the fin assemblies are reattached, the installer need not be concerned with regard to which fin assembly is to be mounted to which mounting region, as will be discussed in greater detail below.

As shown in the drawings, there is a single pair of the fin assemblies 80 mounted proximate the front end of the vehicle body 28, and there are two pairs of fin assemblies 80 mounted proximate the rear end of the vehicle body 28. For each rear pair of fin assemblies 80, the fin assemblies of the pair are arranged on opposite sides of the receptacle slot 36. In accordance with the first embodiment of the present invention, none of the fin assemblies 80, which protrude outwardly from the vehicle body 28, extend below the plane of the lower plate 32. As will be discussed in greater detail below, this feature advantageously allows the intercepting vehicle 20 to dock to a wide variety of differently sized and shaped retrievable vehicles.

As shown in FIGS. 3 and 5-7, pads 82 are mounted to the bottom side of the lower plate 32 and respectively positioned on opposite sides of the receptacle slot 36. As discussed in greater detail below, the pads 82 are optional, and they may be replaced with a variety of differently shaped and/or sized pads 82 and/or the lower plate 32 can be shaped differently for allowing the intercepting vehicle 20 to dock to a wide variety of differently sized and/or shaped retrievable vehicles. FIG. 5 schematically illustrates fasteners 84, such as screws, bolts or the like, for use in removably mounting the pads 82 to the bottom of the lower plate 32.

Figure 8:
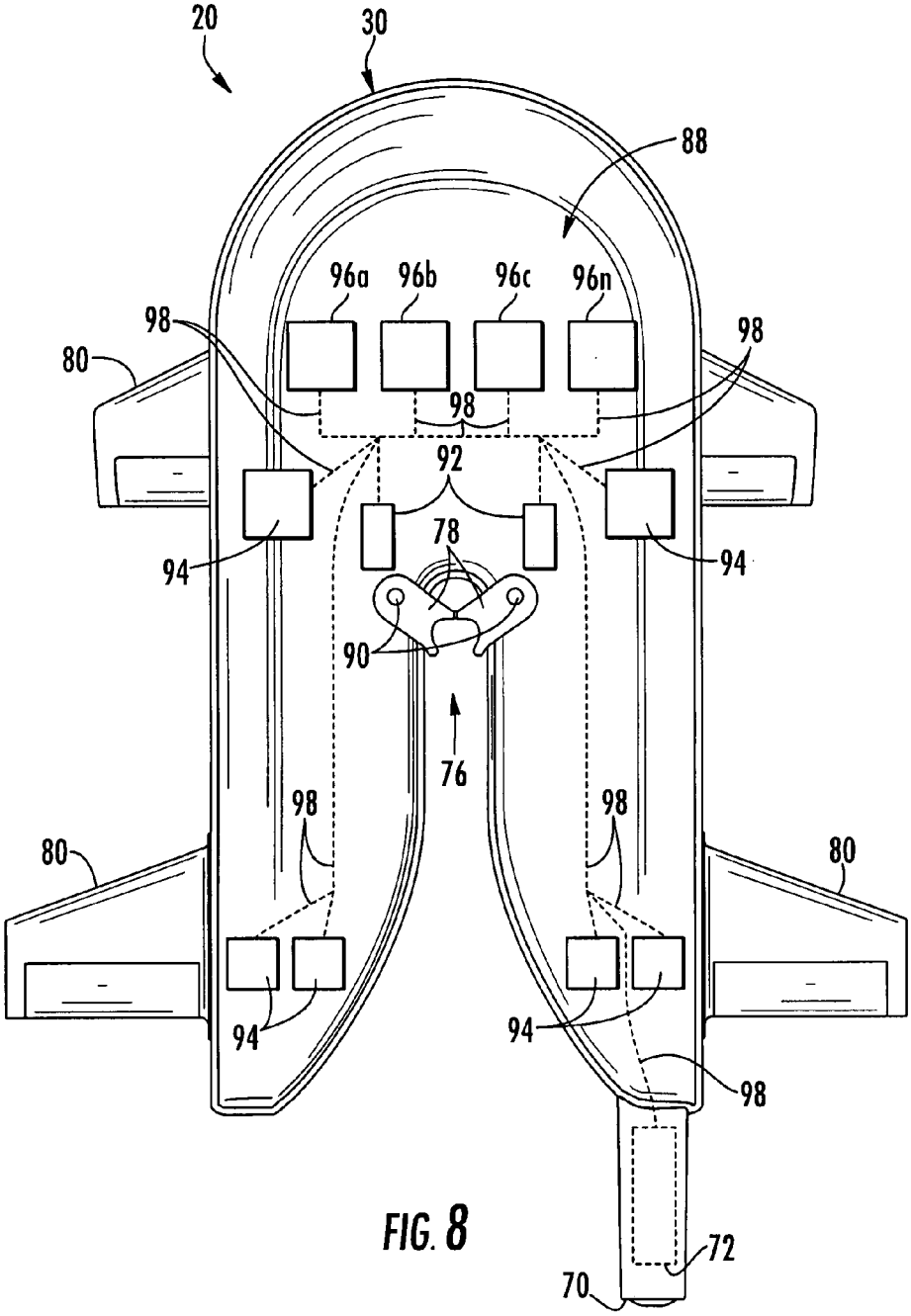
FIG. 8 is a schematic, bottom plan view of the vehicle of FIG. 1, with its lower plate removed, in accordance with the first embodiment of the present invention.

FIG. 5 also schematically illustrates peripherally arranged fasteners 86, such as screws, bolts or the like, by which the lower plate 32 is mounted to the shell 30. FIG. 8 is like FIG. 5, except, for example, that the lower plate 32 is not shown in FIG. 8. As schematically shown in FIG. 8, the shell 30 includes (e.g., defines) a downwardly open chamber 88 that is partially defined by the various outer walls of the shell (e.g., the walls 40, 42, 44, 46, 48, 50, 52 (e.g., see FIGS. 2 and 4) of the shell that partially define the receptacle slot 36). The chamber 88 is closed (e.g., substantially closed) by the lower plate 32, by virtue of the lower plate being mounted to lower edges of the upright walls of the shell 30.

As schematically shown in FIG. 8, the clasps 78 are respectively pivotably mounted via pivot pins 90 that are arranged inside (e.g., mounted in) the chamber 88, although the pivot pins 90 may be positioned outside the chamber or in any suitable position. As also schematically shown in FIG. 8 and as will be discussed in greater detail below, one or more transmitters, receivers and/or transceivers may be carried by the vehicle body 28 of the intercepting vehicle 20 for use in homing in on the retrievable vehicle 26 or a portion thereof. More specifically and in accordance with the first embodiment of the present invention, the homing transceiver 72 is positioned in the transceiver housing 70, and the homing transceiver 72 includes at least one transmitter for transmitting acoustic signals and at least one receiver for receiving acoustic signals, as will be discussed in greater detail below. In FIG. 8, the homing transceiver 72 is hidden from view within the transceiver housing 70 and, therefore, it is schematically illustrated by dashed lines.

FIG. 8 also schematically shows that one or more latch sensors 92 (e.g., proximity sensors) may be positioned in the chamber 88 and associated with the clasps 78 for monitoring the state of the latch 76/clasps 78. FIG. 8 further schematically shows that steering mechanisms 94 are at least partially positioned in the chamber 88 and respectively associated with the fin assemblies 80, as will be discussed in greater detail below.

Figure 12:
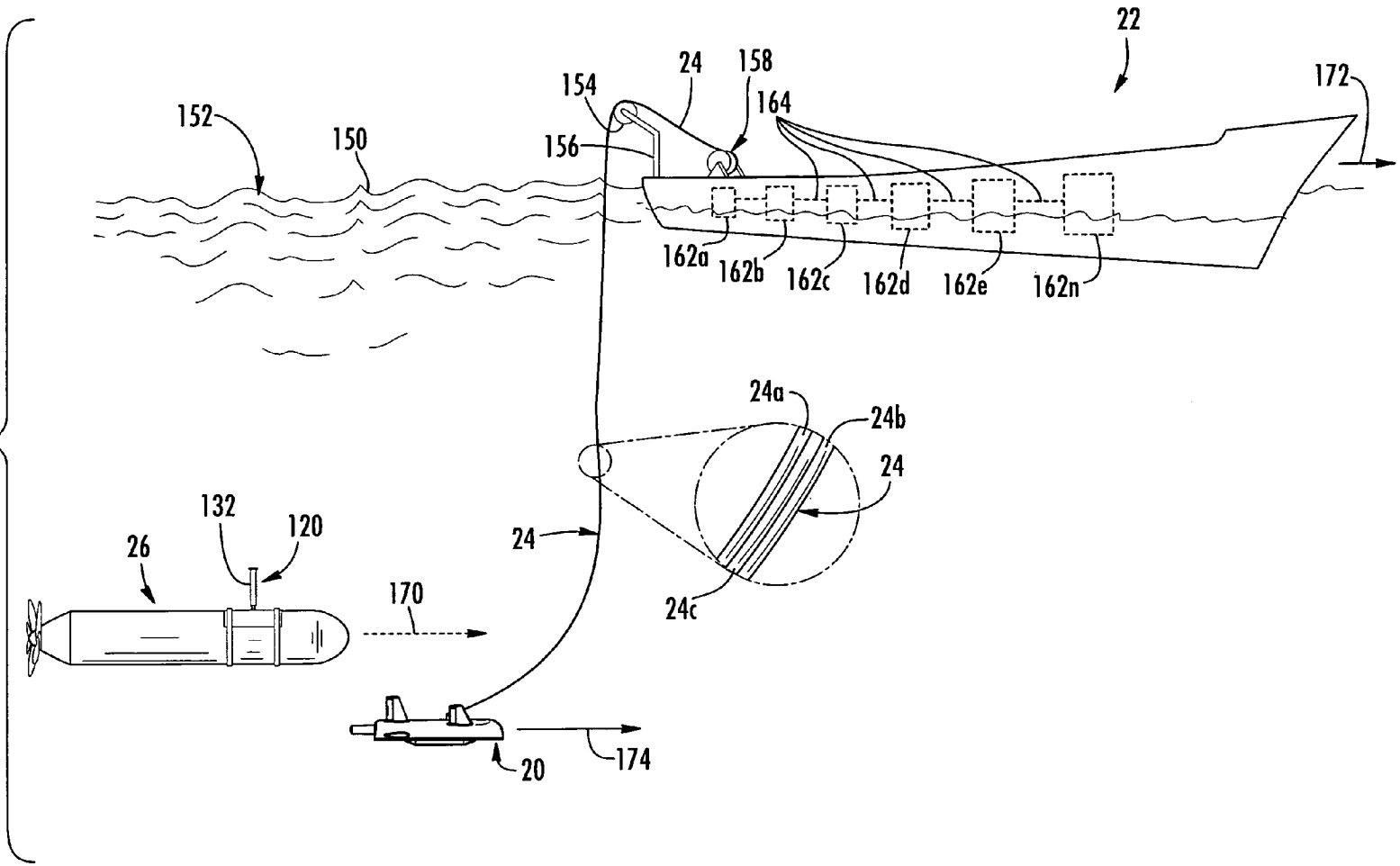
FIG. 12 is a schematic, side view of the retrievable vehicle traveling along a predetermined path and a towing vehicle traveling along a path that at least generally coincides with the predetermined path, with the intercepting vehicle being towed ahead of the retrievable vehicle.

FIG. 8 further schematically illustrates that a variety of other operational components 96*a*, 96*b*, 96*c* . . . 96*n* ("operational components 96*a-n*") for respectively controlling and/or performing operations of the intercepting vehicle 20 may be mounted in the chamber 88 of the shell 30. The one or more other operational components 96*a-n* may include an electrical power supply; a sonar (e.g., depth sensor); a magnetometer; a transceiver (e.g., a communication transceiver) for communicating with the towing vehicle 22 (FIG. 12); a controller (e.g., a computer) for at least partially controlling operation of the intercepting vehicle 20, as will be discussed in greater detail below; and/or any other devices that may be useful, such as for carrying out operations described in this disclosure. The power supply (e.g., which is one of the operational components 96*a-n*) may be in the form of a battery or another suitable device for producing electricity, or it may be in the form of a power interface connected to power line(s) 24*a* (FIG. 12) that provide electricity and may be incorporated into, or otherwise associated with, the tow line 24 (FIG. 12). The communication transceiver (e.g., which is one of the operational components 96*a-n*) may be in the form of transmitter(s) and receiver(s) that are for communicating with the towing vehicle 22 wirelessly and/or by way of communications line(s) 24*b* (FIG. 12) (e.g., wire(s) and/or cable(s) that may be incorporated into, or otherwise associated with, the tow line 24) or by any other suitable means, such as by way of radio frequency signals, acoustic signals, digital signals, optical signals or any other suitable signals. The homing transceiver 72, latch sensor(s) 92, steering mechanisms 94 and one or more other operational components 96*a-n* may communicate with one another by way of internal communication paths (e.g., wirelessly, and/or by way of wire(s) and/or cable(s)). Some of the internal power supply lines and internal communication paths that respectively extend between the components within the shell 30 are schematically illustrated by dashed lines 98 in FIG. 8, and only a few of these dashed lines are identified by their reference numeral 98 in FIG. 8 in an effort to clarify the view.

Those of ordinary skill in the art will understand that FIG. 8 is very schematic in some regards, and that the homing transceiver 72, latch sensor(s) 92, steering mechanisms 94, one or more other operational components 96*a-n* and internal power supply lines/internal communication paths shown by dashed lines 98 in FIG. 8 may be in a variety of different configurations, including some of the features being arranged in different combinations and subcombinations, one or more of the features being omitted, different component(s) being included and/or additional component(s) being included. For example and in accordance with an alternative embodiment of the present invention, the homing transceiver 72 may be replaced with, or supplemented by, one or more visual sensors or devices, such as, but not limited to, charge-coupled device (CCD) camera(s) for obtaining images of the retrievable vehicle 26 or portions thereof. The homing functions of the intercepting vehicle 20 may be based upon, or supplemented with, the images from the camera(s) (e.g., the change in the images over time).

Figure 9:
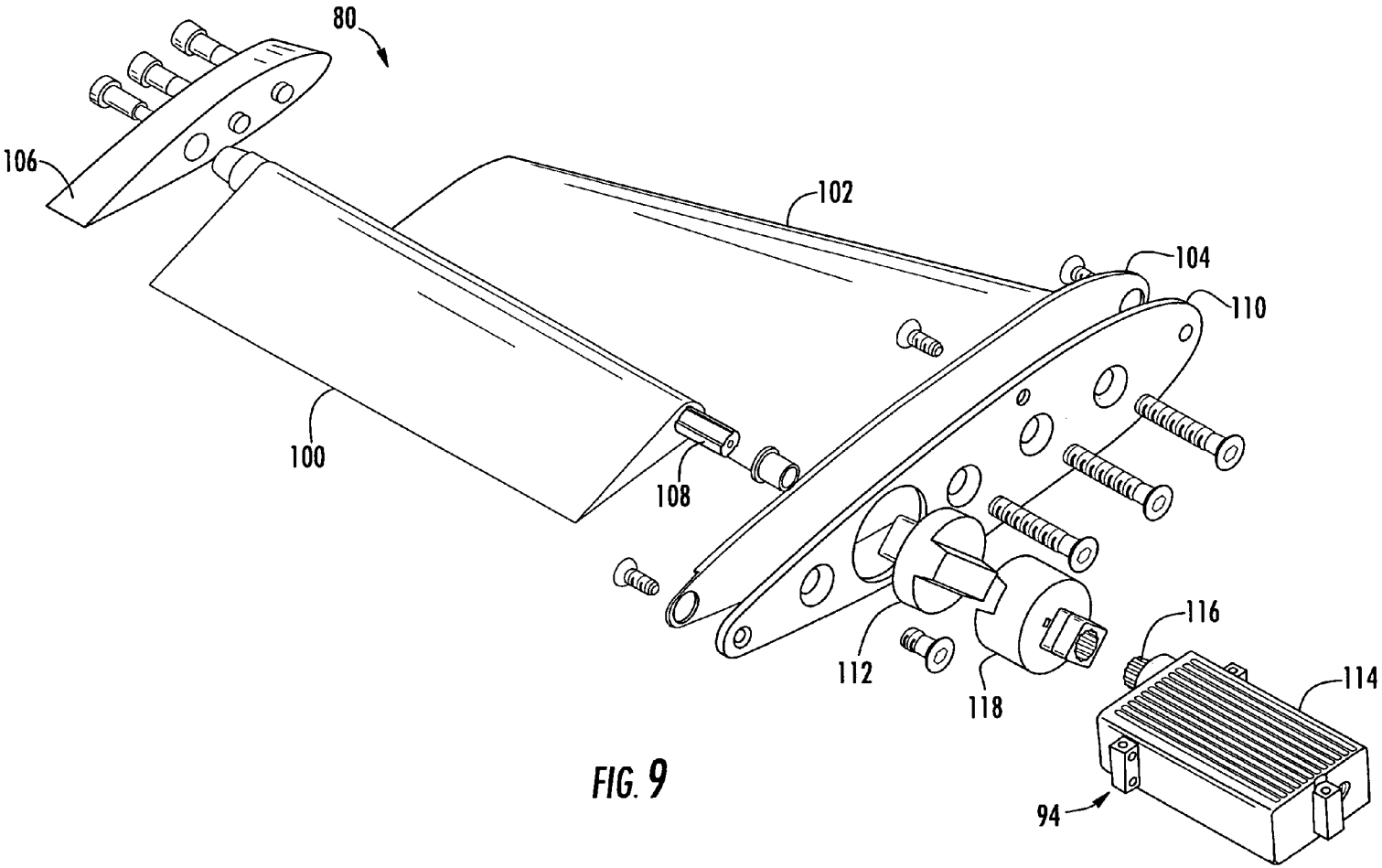
FIG. 9 is a schematic, exploded view of a representative fin assembly and steering mechanism of the vehicle of FIG. 1, in accordance with the first embodiment of the present invention.

In accordance with the first embodiment of the present invention, each of the fin assemblies 80 and steering mechanisms 94 is substantially identical, and FIG. 9 is a schematic exploded view of a representative one of the fin assemblies 80 and its associated steering mechanism 94. As shown in FIG. 9, the fin assembly 80 includes a rudder 100 that is pivotably mounted to a fin. The fin is in the form of a fin body 102 that is positioned forwardly of the rudder 100 and extends between a fin base 104 and a fin tip 106. The rudder 100 is mounted to a pivot shaft 108 having opposite ends that are respectively pivotably mounted to the fin tip 106 and the fin base 104. The fin base 104 is fixedly mounted to a base plate 110. A male connector 112 is pivotably mounted to the base plate 110, and the male connector 112 is fixedly connected to an end of the pivot shaft 108 so that the pivot shaft 108 and the rudder 100 rotate with the male connector 112. Whereas the rudder 100 has been described as being part of the fin assembly 80, the rudder 100 can also be characterized as being part of the steering mechanism 94.

With continued reference to FIG. 9, the steering mechanism 94 includes an electric actuator 114 with a drive shaft 116 that can be rotated back and forth in response to operation of the actuator. A female connector 118 is fixedly mounted to the drive shaft 116 for rotating with the drive shaft 116. The male connector 112 and the female connector 118 respectively include a projection and a receptacle that are cooperatively operative for providing a keyed connection between the rudder 100 and the actuator 114 when the fin assembly 80 is mounted to the vehicle body 28 of the intercepting vehicle 20. These keyed connections respectively between the fin assemblies 80 and steering mechanisms 94 seek to ease the mounting of the fin assemblies 80 to the vehicle body 28 of the intercepting vehicle 20. As will be discussed in greater detail below, by way of the keyed connections, the actuators 114 respectively move the rudders 100 to steer the intercepting vehicle 20, with the actuators operating in response to signals from the controller (e.g., one of the operational components 96*a-n*) of the intercepting vehicle 20. The positions of the male and female connectors 112, 118 may be reversed, and different types of connectors may be used (e.g., the keyed connections that are typically provided for ease of disassembly and reassembly may be omitted).

Figure 10:
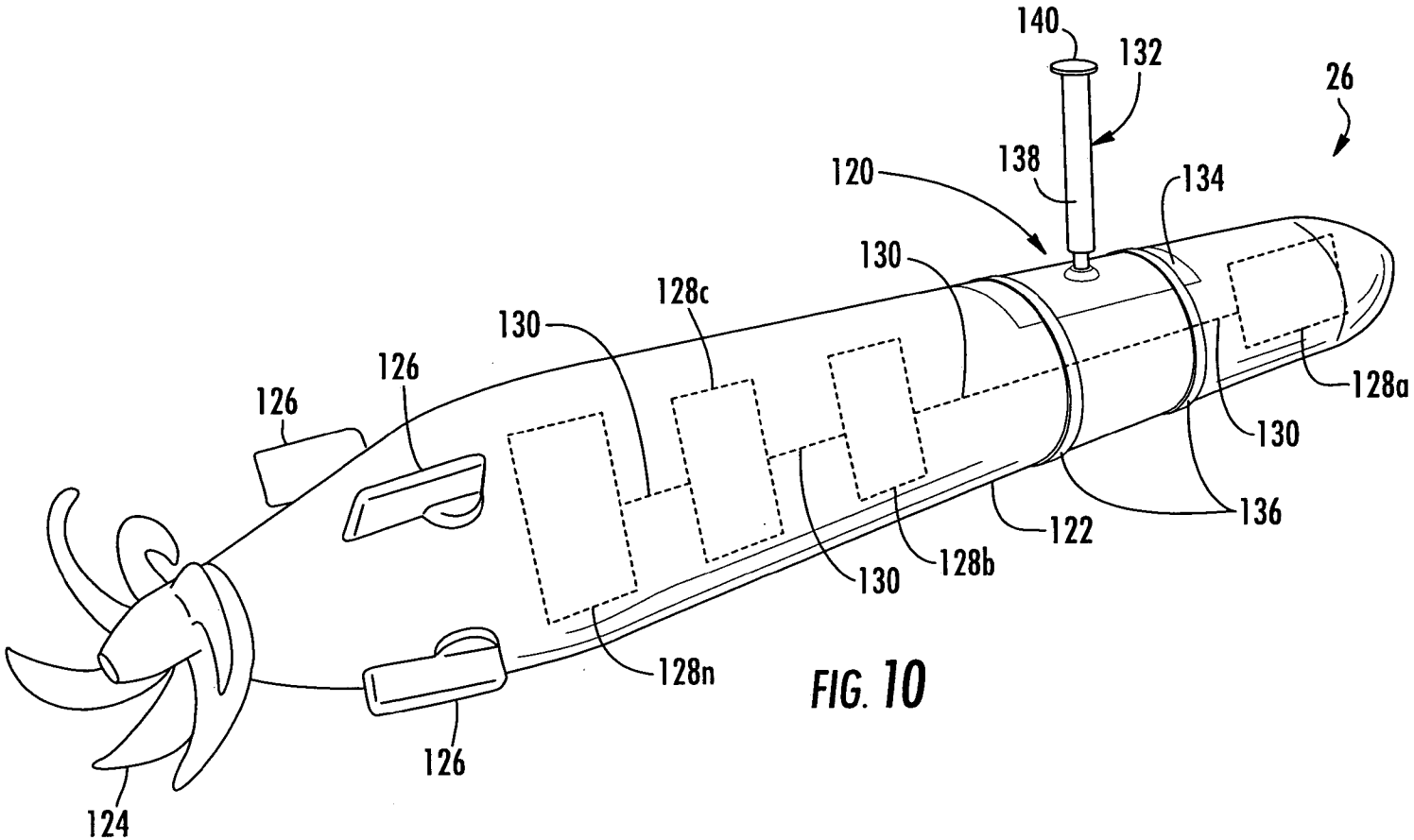
FIG. 10 is a schematic, side/rear perspective view of an unmanned underwater vehicle (e.g., retrievable vehicle) that includes a docking apparatus, in accordance with the first embodiment of the present invention.

In accordance with the first embodiment of the present invention, the retrievable vehicle 26 is a conventional autonomous unmanned underwater vehicle, except that it is equipped with (e.g., retrofitted with) a docking apparatus 120. Whereas a wide variety of differently sized and shaped conventional unmanned underwater vehicles are within the scope of the present invention, the retrievable vehicle 26 schematically shown in FIG. 10 has a hull 122 that is substantially cylindrical between its front and rear ends, a propeller 124 at the rear end for propelling the retrievable vehicle 26, and movable fins 126 for steering the retrievable vehicle 26. FIG. 10 is schematic, for example, because the retrievable vehicle 26 includes numerous operational components 128*a*, 128*b*, 128*c* . . . 128*n* ("operational components 128*a-n*") that are contained within the hull 122 and hidden from view, and the operational components are schematically illustrated by dashed lines in FIG. 10. The operational components 128*a-n* are for respectively controlling and/or performing operations of the retrievable vehicle 26. The operational components 128*a-n* may include an electrical power supply; sonar (e.g., depth sensor); magnetometer; motor, actuators, a transceiver (e.g., a communication transceiver) for communicating with another vehicle, such as the towing vehicle 22 (FIG. 12); a controller (e.g., computer) for at least partially controlling operation of the retrievable vehicle 26; and/or any other devices that may be useful, such as for carrying out operations described in this disclosure. The power supply (e.g., which is one of the operational components 128*a-n*) of the retrievable vehicle 26 may be in the form of a battery or another suitable device for producing electricity.

Those of ordinary skill in the art will understand that the rudders 100 shown in the drawings can be characterized as a trailing edge rudders. That is, in a first version of the first embodiment of the present invention, each fin assembly 80 includes a trailing edge rudder 100. However, other types of fin assemblies and rudders are within the scope of the present invention. For example and in accordance with a second version of the first embodiment of the present invention, each fin assembly 80 is replaced with a pedestal-type of fin assembly (not shown) that includes a fin-shaped pedestal fixed part and a pedestal rudder. The inner end of the pedestal fixed part is fixedly mounted to the vehicle body 28 (e.g., see FIG. 1), and the pedestal rudder is pivotably mounted at the outer end of the pedestal fixed part. The pedestal rudder is operatively connected to the actuator 114 for pivoting relative to the pedestal fixed part in response to operation of the actuator 114, so that the pedestal rudders are used for steering in a manner that is somewhat similar to the manner in which the trailing edge rudders 100 are used for steering.

The communication transceiver (e.g., which is one of the operational components 128*a-n*) of the retrievable vehicle 26 may be in the form of transmitter(s) and receiver(s) that are for communicating wirelessly, such as by way of radio frequency signals, acoustic signals or any other suitable signals. The operational components 128*a-n* of the retrievable vehicle 26 communicate with one another by way of internal communication paths (e.g., wirelessly, and/or by way of wire(s) and/or cables). Some of the internal power supply lines and internal communication paths that respectively extend between the operational components 128*a-n* of the retrievable vehicle 26 are schematically illustrated by dashed lines 130 in FIG. 10.

Those of ordinary skill in the art will understand that FIG. 10 is in some regards very schematic with respect to the features therein that are shown by broken lines, and that the operational components 128*a-n* and internal power supply lines/internal communication paths shown by dashed lines 130 in FIG. 10 may be in a variety of different configurations, including some of the features being arranged in different combinations and subcombinations, one or more of the features being omitted, different component(s) being included and/or and additional component(s) being included.

As shown in FIG. 10, the docking apparatus 120 includes a docking pole 132 having an end mounted to a mounting base 134, and the mounting base 134 is externally mounted to the hull 122 of the retrievable vehicle 26. As will be discussed in greater detail below, the docking pole 132 may be characterized as an object that is for being docked to. In one example, the docking pole 132 is about thirteen inches long. More generally, the docking pole 132 may be between about six inches long and about two feet long, although different lengths may be suitable. As shown in FIG. 10, the mounting base 134 is mounted to the hull 122 by way of fasteners that are in the form of secure straps 136. In addition and/or alternatively, the mounting base 134 may be mounted to the hull 122 by way of any suitable fasteners or fastening mechanisms, such as screws, bolts and/or welding. Typically, the sonar (e.g., which is one of the operational components 128*a-n*) of the retrievable vehicle 26 is at the front end (e.g., in the nose) of the retrievable vehicle 26; therefore, the docking apparatus 120 is typically positioned (e.g., mounted) rearwardly of, and distant from, the front end of the retrievable vehicle 26, so that the sonar is typically isolated from or at least partially protected from any impacts between the docking apparatus 120 and the intercepting vehicle 20, as will be discussed in greater detail below.

Figure 11:
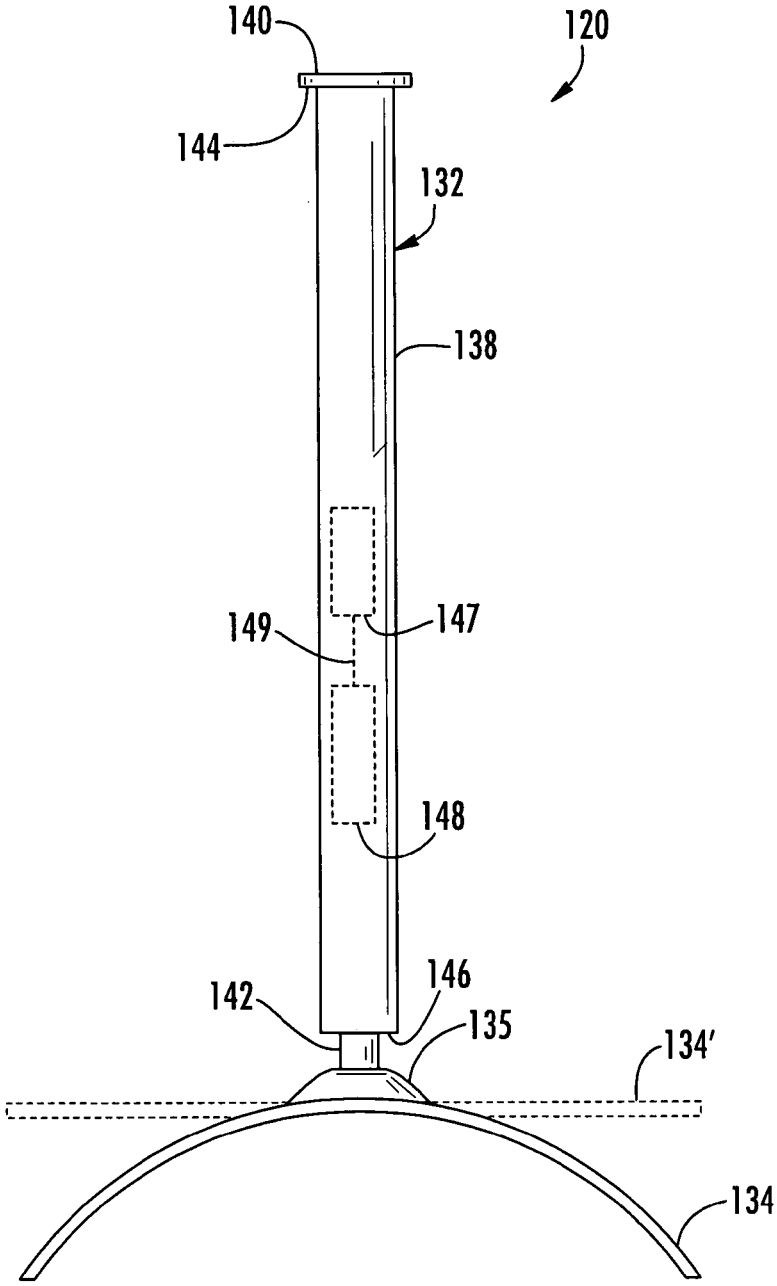
FIG. 11 is a schematic, isolated, front elevational view of the docking apparatus of FIG. 10, in accordance with the first embodiment of the present invention.

FIG. 11 is an isolated, schematic, front elevational view showing the docking apparatus 120 of the first embodiment of the present invention in solid lines (e.g., showing the concave mounting base 134 in solid lines), and schematically showing an alternatively shaped, substantially planar mounting base 134' of the docking apparatus 120 in dashed lines. That is, a variety of differently shaped mounting bases 134 are within the scope of the present invention, so that docking apparatuses 120 of the present invention can be mounted to a variety of differently sized and/or shaped retrievable vehicles, as will be discussed in greater detail below. In addition, it is also within the scope of the present invention for the mounting base 134 to be omitted from the docking apparatus 120, in which case the docking pole 132 may, for example, be mounted directly to the hull 122 of the retrievable vehicle 26 by any suitable mechanisms or methods. For example, whereas the mounting base 134 may be used to advantageously retrofit the docking apparatus 120 to the retrievable vehicle 26, the retrievable vehicle 26 may be originally constructed or be retrofitted so that the docking pole 132 is securely fastened to the hull 122 in another manner, such as by an end of the docking pole 132 being mounted internally to the retrievable vehicle 26.

When the mounting base 134 is mounted externally to the hull 122 of the retrievable vehicle 26, the mounting base 134 typically is broader than the diameter of the pole in order to broadly distribute mechanical stresses. In accordance with the first embodiment, the mounting base 134 has a concave surface that faces away from the docking pole 132 and corresponds to the convex external surface of the hull 122 to which the mounting base 134 is mounted. The lower end of the docking pole 132 may be mounted to the mounting base 134 by way of a mound 135, which may be formed by welding or any other suitable method. In accordance with the first embodiment, the docking pole 132 includes three coaxially arranged cylindrical sections, namely a cylindrical intermediate section 138 having a cylindrical enlarged section 140 (e.g., flange) at one end thereof and a cylindrical indented section 142 at the opposite end.

As will be discussed in greater detail below, each of the enlarged and indented sections 140, 142 is a discontinuity that is adapted for aiding in the docking pole 132 being gripped by the capturing mechanism (e.g., latch 76). That is, the enlarged and indented sections 140, 142 of the docking pole 132 respectively have and/or define annular upper and lower shoulders 144, 146 for engaging the top surfaces of the latch's clasps 78 and thereby aiding in the docking that is discussed in greater detail below.

The docking apparatus 120 further includes a transmitter, which more specifically is a homing beacon 147 that is in the form of a transceiver, namely a transponder. FIG. 11 is schematic, for example, because the homing beacon 147 is hidden from view within the docking pole 132 and, therefore, shown in broken lines. For example, the docking pole 132 or a portion thereof may be in the form of a cylindrical pipe, with closed ends, and the homing beacon 147 may be within the resulting closed chamber within the docking pole. An electrical power supply 148 for providing power to the homing beacon 147 may also be within the chamber in the docking pole 132. Like the homing beacon 147, the power supply 148 is hidden from view in FIG. 11; therefore, it is schematically shown in by dashed lines. Similarly, electrical wiring 149 that connects the power supply 148 to the homing beacon 147 is also hidden from view and schematically shown in dashed lines. For ease of retrofitability, the power supply 148 may be electrically isolated from the operational components 128*a-n* (FIG. 10) within the retrievable vehicle 26 (e.g., may be electrically isolated from a power supply that is one of the operational components 128*a-n* within the retrievable vehicle 26). Accordingly, the power supply 148 and/or the homing beacon 147 within the docking pole 132 may be periodically accessed for servicing (e.g., recharging) by way of connectors and/or a removably attachable fitting. Alternatively, the power supply 148 within the docking pole 132 may be in the form of a power interface connected to power line(s) (not shown) that receive electricity from a power supply that is one of the operational components 128*a-n* within the retrievable vehicle 26.

FIG. 12 is a schematic side view of the intercepting vehicle 20 being towed by the towing vehicle 22 in the vicinity of the retrievable vehicle 26, in preparation for the intercepting vehicle 20 homing in on and attaching to the retrievable vehicle 26 while the retrievable vehicle 26 catches up to the intercepting vehicle 20 from behind, in accordance with the first embodiment of the present invention. As shown in FIG. 12, the towing vehicle 22 is a boat floating on the wavy surface 150 of a body of water 152, and both the intercepting vehicle 20 and the retrievable vehicle 26 are within the body of water 152 beneath its surface 150. For example, both the intercepting vehicle 20 and the retrievable vehicle 26 may be operating at a depth of about 150 feet, although other depths are within the scope of the present invention. In accordance with the first embodiment of the present invention, the towing vehicle 22 is a boat that includes some conventional features. For example, the conventional features of the boat include, but are not limited to, motor(s) (not shown) and propeller(s) (not shown) for propelling, and rudder(s) (not shown) for steering.

As shown in the enlarged portion of FIG. 12, the tow line 24 typically includes a cable for strength 24*c* (e.g., a metal cable), it may optionally further include power line(s) 24*a* for providing electrical power to the intercepting vehicle 20, and it may optionally further include communication line(s) 24*b* over which the intercepting vehicle 20 and the towing vehicle 22 communicate with one another. The tow line may extend over an idler pulley 154 that is carried by a crane-like and/or arm-like boom 156, which is carried by the towing vehicle 22. The tow line 24 may be unreeled/let out and reeled in by way of a winch 158, which is carried by the towing vehicle 22. It may be satisfactory for the boom 156 and associated pulley 154, as well as the winch 158, to be conventional. Alternatively, the tow line 24 may be unreeled/let out and reeled in by any other acceptable method and/or devices for letting out and retrieving the tow line 24.

FIG. 12 is schematic, for example, because the towing vehicle 22 includes numerous operational components 162*a*, 162*b*, 162*c*, 162*d*, 162*e* . . . 162*n* ("operational components 162*a-n*") that are carried by the towing vehicle 22 and are schematically illustrated by dashed lines in FIG. 12. The operational components 162*a-n* are for respectively controlling, performing and/or aiding in the performance of operations associated with the towing vehicle 22. The operational components 162*a-n* may include an electrical power supply; a sonar which may operate using acoustic signals; a magnetometer; a motor, actuators, transceivers (e.g., communication transceivers) for communicating with one or more other vehicle, such as the intercepting vehicle 20 and the retrievable vehicle 26; a controller (e.g., computer) for use, for example, in at least partially controlling and/or aiding a user in operation of the towing vehicle 22; a global positioning system ("GPS") receiver (e.g., a GPS navigational system); and/or any other devices that may be useful, such as for carrying out operations described in this disclosure. Those of ordinary skill in the art will understand that a GPS receiver is not novel per se, and that the GPS receiver can receive signals from satellites to determine the location of the GPS receiver, and the direction and speed at which the GPS receiver is traveling.

A first communication transceiver (e.g. which is one or more of the operational components 162*a-n*) of the towing vehicle 22 may be in the form of transmitter(s) and receiver(s) that are for communicating wirelessly, such as by way of radio frequency signals, acoustic signals or any other suitable signals, with the retrievable vehicle 26. A second communication transceiver (e.g., which is one of the operational components 162*a-n*) of the towing vehicle 22 may be in the form of transmitter(s) and receiver(s) that are for communicating with the intercepting vehicle 20 wirelessly and/or by way of the communications line(s) 24*b* or by any other suitable means, such as by way of radio frequency signals, acoustic signals, digital signals, optical signals or any other suitable signals. The operational components 162*a-n* of the towing vehicle 22 communicate with one another by way of internal communication paths (e.g., wirelessly, and/or by way of wire(s) and/or cables). Some of the internal power supply lines and internal communication paths that respectively extend between the operational components 162*a-n* of the towing vehicle 22 are schematically illustrated by dashed lines 164 in FIG. 12, and only a few of these dashed lines are identified by their reference numeral 164 in FIG. 12 in an effort to clarify the view.

As will be discussed in greater detail below with reference to FIGS. 20-22 in accordance with the first embodiment of the present invention, when the intercepting vehicle 20 successfully automatically steers itself/homes in on the retrievable vehicle 26 while the retrievable vehicle 26 catches up to the intercepting vehicle 20 from behind, the docking pole 132 enters the receptacle slot 36 of the intercepting vehicle 20 and is grasped by the latch 76 of the intercepting vehicle 20, so that the intercepting vehicle 20 and the retrievable vehicle 26 become fixedly attached/docked to one another. Then, the intercepting vehicle 20, with the retrievable vehicle 26 attached/docked thereto, is typically brought to the towing vehicle 22 by reeling in the tow line 24 that is securely fastened to the intercepting vehicle 20. For example, the tow line 24 is typically reeled in by way of the winch 158 (e.g., the tow line 24 is wound up onto a spool or drum through the operation of a manual crank or more typically through the operation of a motor that is connected to the spool or drum by appropriate gearing) or by using any other suitable apparatus and/or method. Then, as part of the reeling or an additional operation, the intercepting vehicle 20, with the retrievable vehicle 26 docked thereto, may be brought onboard the towing vehicle 22. For example, the intercepting vehicle 20, with the retrievable vehicle 26 docked thereto, may be reeled in so that it is suspended by the crane-like and/or arm-like boom 156, and thereafter the boom 156 may be pivoted, swiveled and/or articulated in a manner that the intercepting vehicle 20, with the retrievable vehicle 26 docked thereto, is placed on the deck (e.g., lowered onto the deck by unreeling a short portion of the tow line 24) of the towing vehicle 22 or otherwise placed in a desired location. Thereafter, the intercepting vehicle 20 may be released from the retrievable vehicle 26 and reused, and typically the retrievable vehicle 26 may also be reused, as will be discussed in greater detail below.

Examples of methods by which the intercepting vehicle 20 may home in on the retrievable vehicle 26 while the retrievable vehicle 26 catches up to the intercepting vehicle 20, and by which the retrievable vehicle 26 is grasped by the latch 76 of the intercepting vehicle 20, are described in the following, in accordance with the first embodiment of the present invention. For example, FIG. 13 is a block diagram (e.g., flow diagram) that schematically illustrates operations, steps, structures and/or software modules, or the like, associated with the intercepting vehicle 20 homing in on and latching to the retrievable vehicle 26.

Figure 13A:
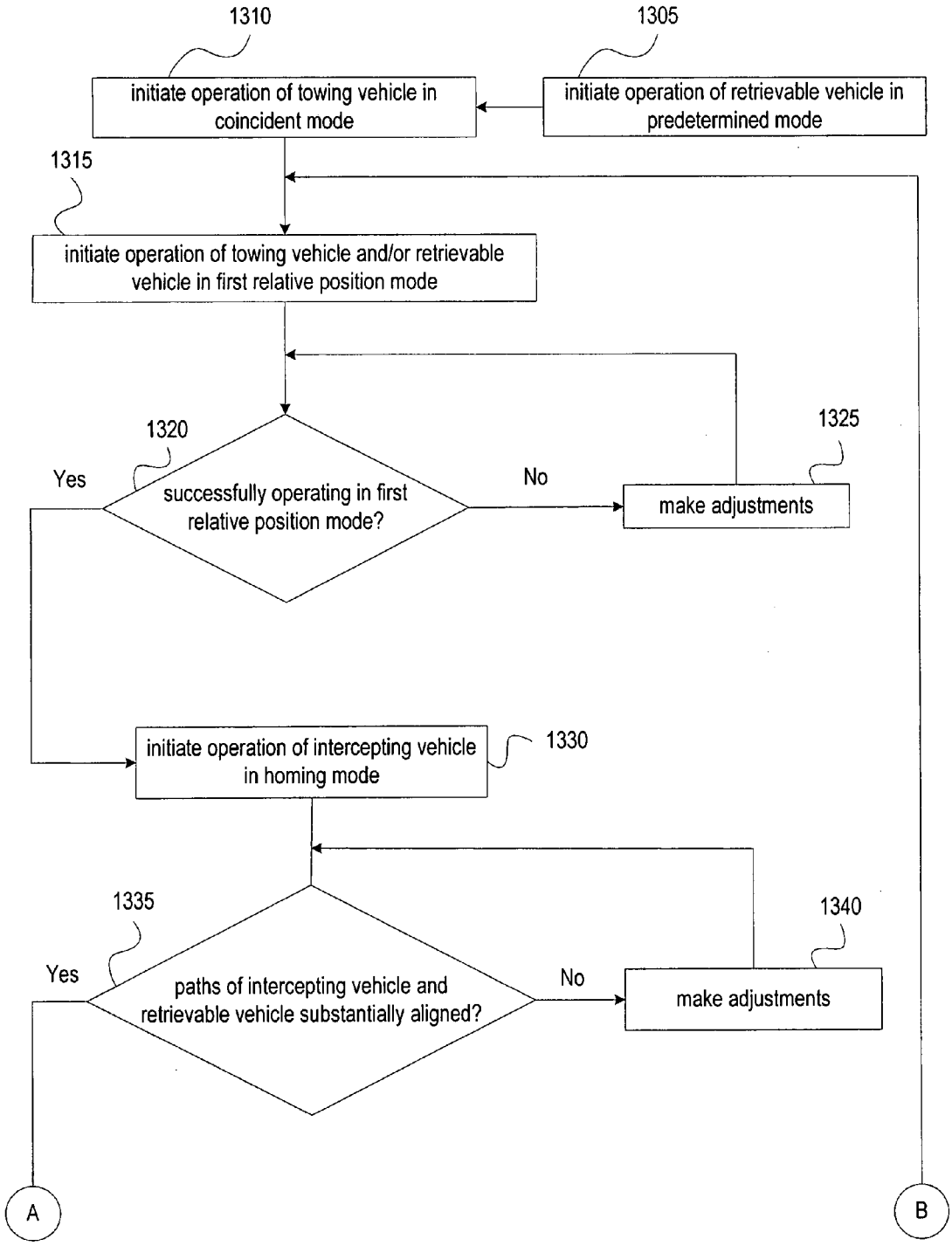
FIGS. 13A and 13B present a block diagram that schematically illustrates operations, steps, structures and/or software modules, or the like, associated with the intercepting vehicle homing in on the retrievable vehicle and retrieval of the retrievable vehicle, in accordance with an exemplary method of the first embodiment of the present invention.
Figure 13B:
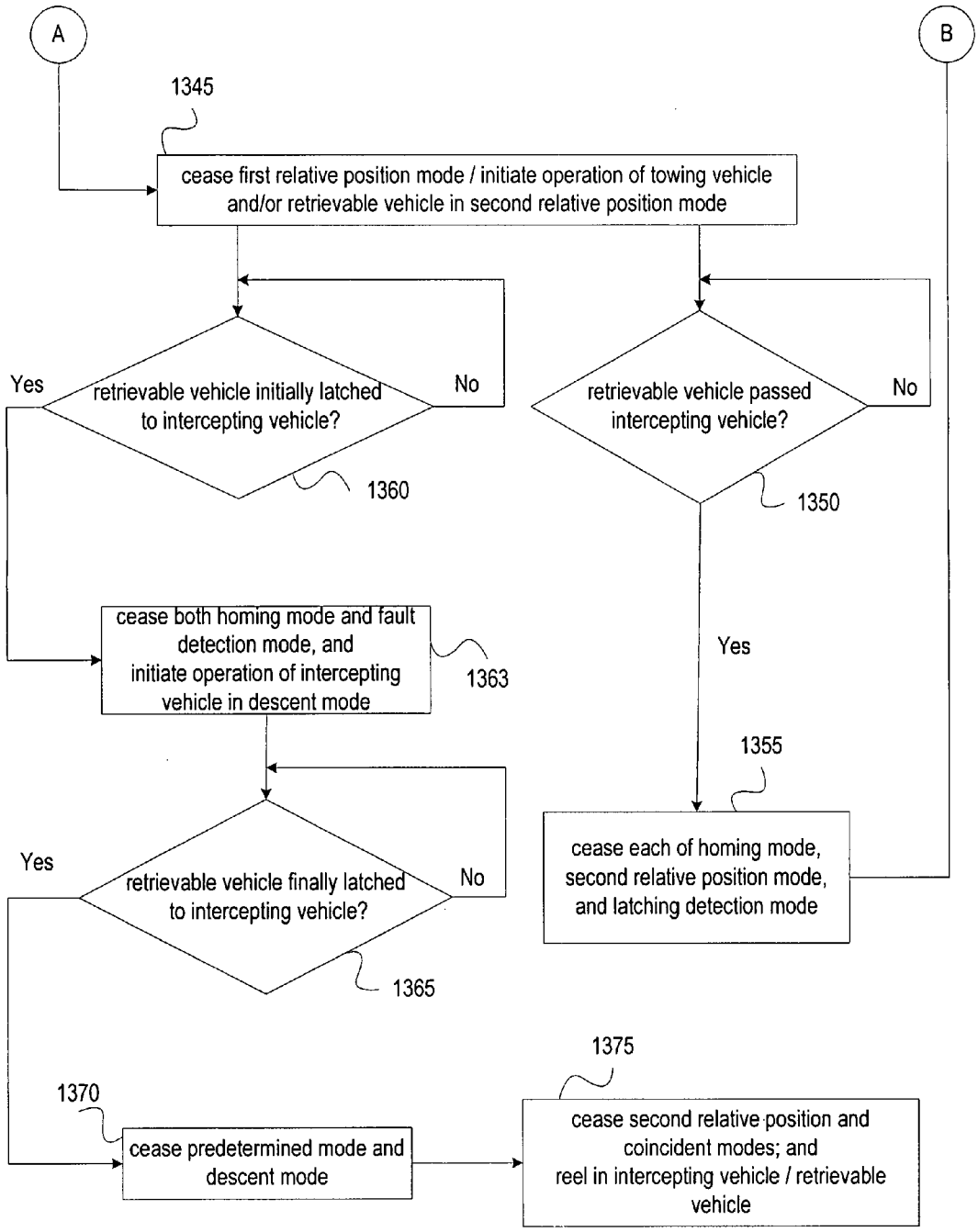
Figure 14:
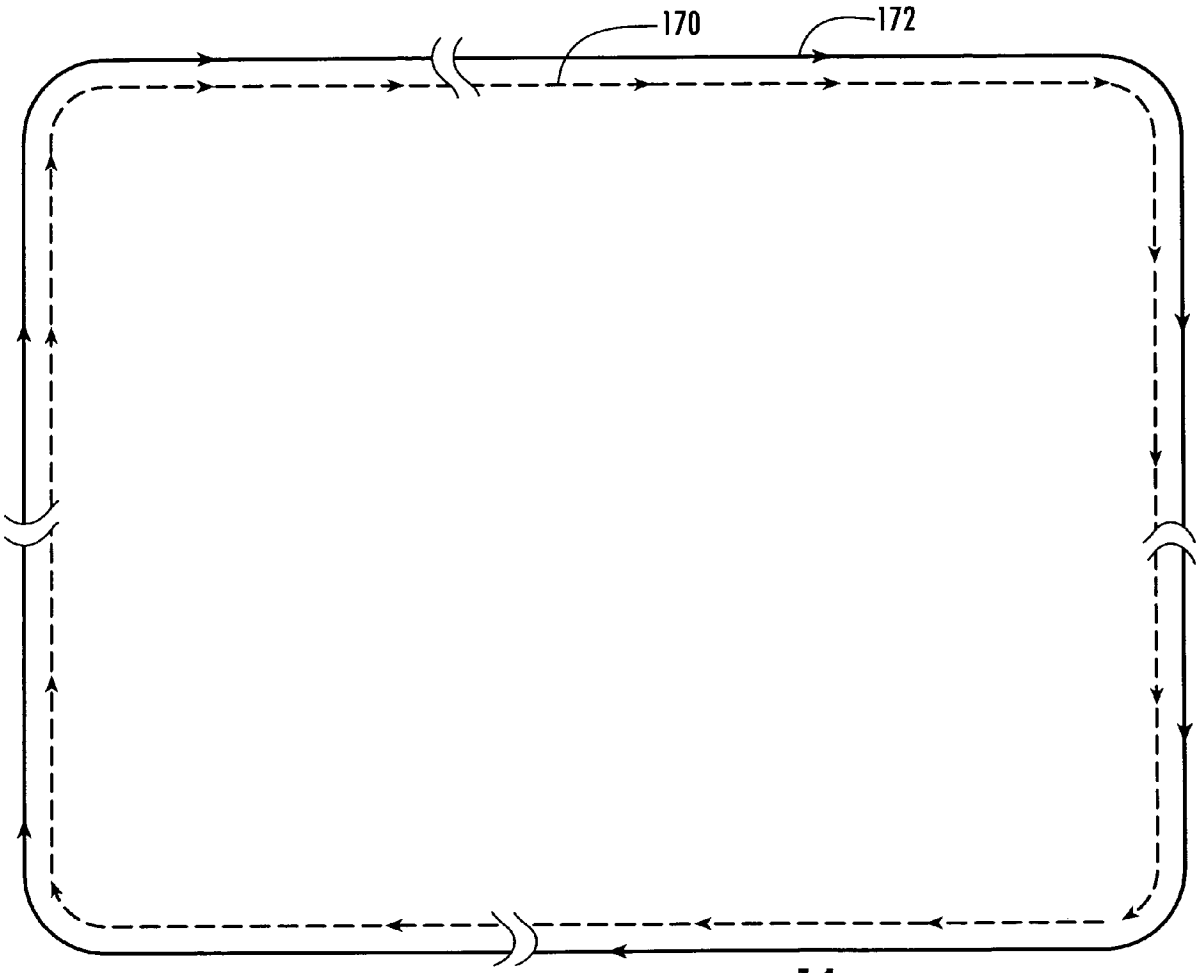
FIG. 14 is a schematic, top plan view showing a predetermined path of the retrievable vehicle substantially aligned with a coincident path of the towing vehicle, in accordance with the exemplary method of the first embodiment of the present invention.

At block 1305 of FIG. 13, instructions are provided (e.g., from the towing vehicle 22) to the retrievable vehicle 26, to initiate operation of the retrievable vehicle 26 in a predetermined mode so that it travels along a predetermined path 170 (e.g., FIG. 14). As shown in FIG. 14, in one example, the predetermined path 170 that the retrievable vehicle 26 is instructed to travel along is a circuitous path, or even more specifically, a generally rectangular path, as schematically shown by the dashed line/dashed arrows 170 in FIG. 14. The instructions that are schematically illustrated by block 1305, as well as all other instructions that are discussed herein as being provided to the retrievable vehicle 26, may, for example, be communicated from a transmitter of the operational components 162*a-n* (FIG. 12) of the towing vehicle 22 to a receiver of the operational components 128*a-n* (FIG. 10) of the retrievable vehicle 26, such as by way of acoustic signals, or by way of any other suitable methods or mechanisms, and the instructions may then be stored on a computer-readable memory of the operational components 128*a-n* of the retrievable vehicle 26. These instructions may be executed by a computer processor/automatic navigational system of the operational components 128*a-n* of the retrievable vehicle 26 so that signals, instructions or the like are provided to motor(s) and actuator(s) of the retrievable vehicle 26 that are respectively associated with its propeller 124 and fins 126 for causing the retrievable vehicle 26 to travel along the predetermined path 170.

As shown in FIG. 13, control is transferred from block 1305 to block 1310, although the operations associated with block 1310 may occur before or at the same time as the operations associated with block 1305. At block 1310, instructions are generated at or provided to the towing vehicle 22 to initiate operation of the towing vehicle 22 in a coincident mode, so that the towing vehicle 22 travels along a coincident path 172 (e.g., FIG. 14) that at least generally coincides (e.g., in a top plan view) with the predetermined path 170 of the retrievable vehicle 26. The coincident path 172 of the towing vehicle 22 is schematically shown by solid lines and associated arrows 172 in FIG. 14. The coincident path 172 of the towing vehicle 22 may initially be charted to at least generally track the predetermined path 170 of the retrievable vehicle 26 by using GPS coordinates that are intended to correspond to the predetermined path 170 of the retrievable vehicle 26 and/or by observing the predetermined path 170 of the retrievable vehicle 26 using one or more other components (e.g., sonar that uses acoustic signals) of the operational components 162*a-n* (FIG. 12) of the towing vehicle 22.

Generally described, the motor(s) (not shown) and rudder(s) (not shown) of the towing vehicle 22 may be either directly or indirectly manually controlled ("manually controlled") in an effort to cause the towing vehicle 22 to travel along the coincident path 172, such as under the guidance of one or more of the operational components 162*a-n* (FIG. 12) (e.g., a GPS receiver) of the towing vehicle 22 or by way of any other suitable methods or mechanisms. Throughout the remainder of this Detailed Description section of this disclosure, it should be understood that reference to "manual control" of the towing vehicle 22 or the towing vehicle 22 being "manually controlled", or the like, means, for example, that the motor(s) and/or rudder(s) of the towing vehicle 22 are either directly or indirectly manually controlled in an effort to cause the desired result. Alternatively and generally described, the motor(s) and rudder(s) of the towing vehicle 22 may be automatically controlled by way of one or more of (e.g., a GPS automatic navigation system of) the operational components 162*a-n* of the towing vehicle 22, or by any other suitable methods or mechanisms. Throughout the remainder of this Detailed Description section of this disclosure, it should be understood that reference to "automatic control" of the towing vehicle 22 or the towing vehicle 22 being "automatically controlled", or the like, means, for example, that the motor(s) and/or rudder(s) of the towing vehicle 22 are automatically controlled in an effort to cause the desired result.

In some situations, it might be possible for the towing vehicle 22 and the retrievable vehicle 26 to be operated so that the predetermined path 170 of retrievable vehicle and the coincident path 172 of the towing vehicle are substantially aligned in a top plan view. As mentioned above and discussed in greater detail below, the intercepting vehicle 20 automatically steers itself/homes in on the retrievable vehicle 26, and this steering/homing seeks, among other things, to compensate for misalignment between the predetermined path 170 of the retrievable vehicle 26 and the coincident path 172 of the towing vehicle 22. Accordingly, the intercepting vehicle 20 can be characterized as traveling along a homing path 174 that is schematically shown by a solid line and associated arrows 174 in FIG. 15. Ideally (e.g., in accordance with some examples of the present invention), the predetermined path 170 of the retrievable vehicle 26 and the coincident path 172 of the towing vehicle 22 are initially substantially aligned (e.g., in a plan view) and a sufficient length of the tow line 24 is provided, so that the homing path 174 of the intercepting vehicle 20 is capable of being substantially aligned with the predetermined path 170 of the retrievable vehicle 26 without requiring adjustment to the initially established predetermined path 170 of the retrievable vehicle 26 and the coincident path 172 of the towing vehicle 22.

In contrast, in some situations, the predetermined path 170 of the retrievable vehicle 26 and the coincident path 172 are substantially misaligned, such as due to environmental conditions (e.g., wind, current and/or waves) or due to inaccuracies associated with, for example, the navigational system or other operational aspects of one or more of the towing vehicle 22 and the retrievable vehicle 26. That is, typically the predetermined path 170 of the retrievable vehicle 26 and the coincident path 172 of the towing vehicle 22 are not perfectly aligned, and at least initially these paths may be substantially misaligned. Similarly and as best understood with reference to FIGS. 14 and 15, at least initially there is typically both vertical and horizontal misalignment between the predetermined path 170 of the retrievable vehicle 26 and the homing path 174 of the intercepting vehicle 20. The reasons for these misalignments may, for example, include exposure of the towing vehicle 22 to waves and wind, and exposure of the intercepting and retrievable vehicles 20, 26 to underwater currents. Reasons for the misalignment may also include the navigational systems, or the like, of the towing vehicle 22 and/or the retrievable vehicle 26 being out of calibration or otherwise in a degraded state.

Very generally described and as will be discussed in greater detail below, when there is only moderate misalignment between predetermined path 170 of the retrievable vehicle 26 and the coincident path 172 of the towing vehicle 22 and a sufficient length of the tow line 24 is provided, the intercepting vehicle 20 may home in on the retrievable vehicle 26/sufficiently steer itself in order to compensate for the misalignment and substantially align its homing path 174 with the predetermined path 170 of the retrievable vehicle 26. However, in some situations, the length of the tow line 24 and/or other factors (e.g., excessive underwater currents or obstructions (e.g., excessive seaweed)) may limit the ability of the intercepting vehicle 20 to steer far enough to compensate for the misalignment between predetermined path 170 of the retrievable vehicle 26 and the coincident path 172 of the towing vehicle 22, as will be discussed in greater detail below.

As shown in FIG. 13, control is transferred from block 1310 to block 1315. The intercepting vehicle 20 may be placed in the body of water 152, such as by attaching it to the tow line 24 and unreeling/letting out the tow line 24 by way of the winch 158, at any appropriate time, such as prior to the actions taken at block 1315. Typically the intercepting vehicle 20 is towed by the towing vehicle 22 (e.g., by way of the motor(s) of the towing vehicle 22 propelling the towing vehicle 22) throughout the operations that occur from block 1315 through at least block 1365, and such towing of the intercepting vehicle may continue through the reeling in of the vehicles 20, 26 that occurs at block 1375.

At block 1315, operation of the towing vehicle 22 and/or retrievable vehicle 26 in a first relative position mode is initiated in an effort to maintain the intercepting vehicle 20 a predetermined distance (e.g., within a range of acceptable distances) ahead of the retrievable vehicle 26. The first relative position mode of operation seeks to prevent inadvertent contact between the intercepting vehicle 20 and the retrievable vehicle 26 prior to the paths 170, 174 of these vehicles being satisfactorily (e.g., substantially) aligned for docking, as will be discussed in greater detail below. In accordance with the first embodiment of the present invention, only the towing vehicle 22 is operated in the first relative position mode, and operation of the retrievable vehicle 26 is steady state (e.g., typically intentional adjustments are not made to the predetermined path 170 of the retrievable vehicle 26 or the speed at which the retrievable vehicle 26 travels along the predetermined path 170) throughout the operations associated with blocks 1310 through 1370.

Very generally described, one or more of (e.g., the computer of) the operational components 96*a-n* of the intercepting vehicle 20 can operate in conjunction with the homing transceiver 72 (FIG. 8) of the intercepting vehicle 20, while the homing transceiver 72 of the intercepting vehicle 20 operates in conjunction with the homing beacon 147 (FIG. 11) of the retrievable vehicle 26, so that the distance between the homing transceiver 72 of the intercepting vehicle 20 and the homing beacon 147 of the retrievable vehicle 26, and direction from the homing transceiver 72 of the intercepting vehicle 20 to the homing beacon 147 of the retrievable vehicle 26, can be determined. That is, throughout the Detailed Description section of this disclosure, determinations of the distance between the homing transceiver 72/intercepting vehicle 20 and the homing beacon 147/retrievable vehicle 26, and the direction from the homing transceiver 72/intercepting vehicle 20 to the homing beacon 147/retrievable vehicle 26 may be made through the use of one or more of (e.g., the computer of) the operational components 96*a-n* of the intercepting vehicle 20 operating in conjunction with the homing transceiver 72 of the intercepting vehicle 20, while the homing transceiver 72 of the intercepting vehicle 20 operates in conjunction with the homing beacon 147 of the retrievable vehicle 26. In addition or alternatively, the distance between, and direction of relative movement between, the intercepting vehicle 20 and the retrievable vehicle 26 may be determined by any other suitable method or devices (e.g., through the use of the sonar device of the operational components 162*a-n* of the towing vehicle 22).

Accordingly, whether or not the intercepting vehicle 20 is a predetermined distance ahead of retrievable vehicle 26 can be determined through the use of at least the homing transceiver 72 and the homing beacon 147 and/or the sonar device of the operational components 162*a-n* of the towing vehicle 22. More specifically and in accordance with the first embodiment of the present invention, after the first relative position mode of operation is initiated at block 1315, control is transferred to block 1320, where a determination is made as to whether the towing vehicle 22 is operating at a proper speed such that the system is successfully operating in the first relative position mode (e.g., whether the intercepting vehicle 20 is a predetermined distance ahead of retrievable vehicle 26). The determination at block 1320 may be made, for example, through the use of at least the homing transceiver 72 and the homing beacon 147, and/or through the use of any other acceptable methods and mechanisms, such as the sonar device of the operational components 162*a-n* of the towing vehicle 22. If it is determined at block 1320 that the system is not successfully operating in the first relative position mode (e.g., that the intercepting vehicle 20 is not a predetermined distance ahead of retrievable vehicle 26), then control is transferred to block 1325. At block 1325, adjustments are made in an effort to cause the system to successfully operate in the first relative position mode (e.g., so that the intercepting vehicle 20 becomes a predetermined distance ahead of retrievable vehicle 26).

Figure 16:
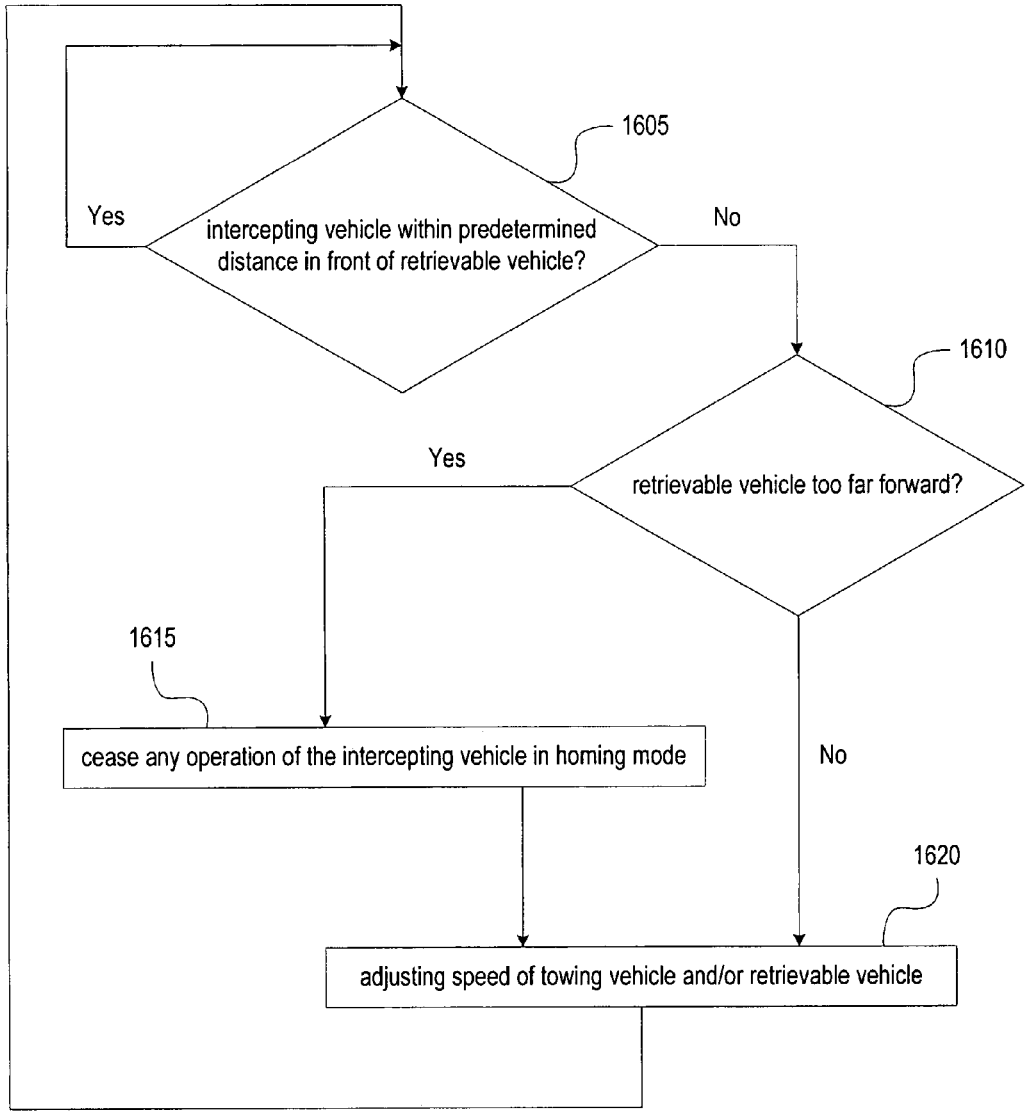
FIG. 16 is a block diagram that schematically illustrates operations, steps, structures and/or software modules, or the like, associated with operating the towing vehicle in a first relative position mode in an effort to temporarily maintain the intercepting vehicle a predetermined distance ahead of the retrievable vehicle, in accordance with the exemplary method of the first embodiment of the present invention.

FIG. 16 is a block diagram (e.g., flow diagram) that schematically illustrates operations, steps, structures and/or software modules, or the like, associated with blocks 1320 and 1325 of FIG. 13. The block diagram of FIG. 16 is directed to operating the towing vehicle 22 in the first relative position mode, by making any needed adjustments, in an effort to maintain the intercepting vehicle 20 a predetermined distance ahead of retrievable vehicle 26. At block 1605 of FIG. 16, a determination is made as to whether the intercepting vehicle 20 is within a predetermined distance in front of the retrievable vehicle 26. For example, it may be suitable for the intercepting vehicle 20 to be more than about a few feet in front of, but not more than about fifteen or twenty feet in front of, the retrievable vehicle 26.

If it is determined at block 1605 of FIG. 16 that the intercepting vehicle 20 is not within the predetermined distance in front of retrievable vehicle 26, then control is transferred to block 1610. At block 1610 a determination is made at least as to whether the retrievable vehicle 26 has prematurely caught up to (e.g., is in front of or beside) the intercepting vehicle 20.

If it is determined at block 1610 that the retrievable vehicle 26 has not caught up to (e.g., is not in front of or beside) the intercepting vehicle 20, then control is transferred to block 1620, which is discussed in greater detail below.

If it is determined at block 1610 of FIG. 16 that the retrievable vehicle 26 has caught up to (e.g., is in front of or beside) the intercepting vehicle 20, then control is transferred to block 1615. At block 1615, any operating of the intercepting vehicle 20 in homing mode is temporarily terminated (in an effort to avoid an inadvertent collision between the intercepting vehicle 20 and the retrievable vehicle 26), and control is transferred to block 1620. The homing mode of the intercepting vehicle 20, which is initiated at block 1330 of FIG. 13, is discussed in greater detail below.

When control is transferred to block 1620 of FIG. 16, adjustments are made to the speed of the towing vehicle 22 and/or the speed of the retrievable vehicle 26 in an effort to temporarily maintain the intercepting vehicle 20 the predetermined distance ahead of the retrievable vehicle 26. Stated differently, at block 1620, the speed of the towing vehicle 22 and/or the speed of the retrievable vehicle 26 is adjusted in a manner that seeks to keep the intercepting vehicle 20 within, or cause the intercepting vehicle 20 to become within, the predetermined distance in front of retrievable vehicle 26. In accordance with the first embodiment of the present invention, only the speed of the towing vehicle 22 is adjusted at block 1620 and operation of the retrievable vehicle 26 is typically steady state (e.g., typically intentional adjustments are not made to the speed at which the retrievable vehicle 26 travels along the predetermined path 170). The adjustments to the speed of the towing vehicle 22 that are made at block 1620 can be made by manually controlling and/or automatically controlling the speed of the towing vehicle 22.

Control is transferred from block 1620 to block 1605. If it is determined at block 1605 that the intercepting vehicle 20 is within the predetermined distance in front of the retrievable vehicle 26, then control remains/loops back to block 1605 in a do-loop like fashion, so that it is substantially continuously determined whether the intercepting vehicle 20 is within the predetermined distance in front of retrievable vehicle 26, so long as the system is operating in the first relative position mode initiated at block 1315 of FIG. 13.

Referring back to FIG. 13, when it is determined at block 1320 that the system is successfully operating in the first relative position mode (e.g., that the intercepting vehicle 20 is the predetermined distance (e.g., within a range of acceptable distances) ahead of retrievable vehicle 26), then control is transferred to block 1330. The homing mode of the intercepting vehicle 20 is initiated at block 1330. During the homing mode, at least the direction from the homing transceiver 72/intercepting vehicle 20 to the homing beacon 147/retrievable vehicle 26 is determined, for example, through the use of one or more of (e.g., the computer of) the operational components 96*a-n* of the intercepting vehicle 20 operating in conjunction with the homing transceiver 72 of the intercepting vehicle 20, while the homing transceiver 72 of the intercepting vehicle 20 operates in conjunction with the homing beacon 147 of the retrievable vehicle 26. Also during the homing mode, in response to the determination of the direction from the homing transceiver 72/intercepting vehicle 20 to the homing beacon 147/retrievable vehicle 26, the intercepting vehicle 20 is steered through the use of one or more of (e.g., the computer of) the operational components 96*a-n* of the intercepting vehicle 20 operating in conjunction with (e.g., respectively providing instructions to) the steering mechanisms 94 (e.g., see FIGS. 8 and 9) of the intercepting vehicle 20. More specifically and in accordance with the first embodiment of the present invention, while the intercepting vehicle 20 is operating in the homing mode, it automatically steers itself in an effort to cause the homing path 174 of the intercepting vehicle 20 to become at least substantially aligned with the predetermined path 170 of the retrievable vehicle 26. As a result, the intercepting vehicle 20 is operative to compensate for moderate misalignments between the predetermined path 170 of the retrievable vehicle 26 and the coincident path 172 of the towing vehicle 22. That is, when there is only moderate misalignment between the predetermined path 170 of the retrievable vehicle 26 and the coincident path 172 of the towing vehicle 22, the intercepting vehicle 20 automatically steers itself (while it is being towed by the towing vehicle 22) into the predetermined path 170 of the retrievable vehicle 26, so that the homing path 174 of the intercepting vehicle 20 is substantially aligned with the predetermined path 170 of the retrievable vehicle 26. On the other hand and as schematically shown in FIG. 15, for example, if misalignment between the predetermined path 170 of the retrievable vehicle 26 and the coincident path 172 of the towing vehicle 22 are too great and/or the length of the tow line 24 is too short, then the intercepting vehicle 20 will be unable to steer itself into the predetermined path 170 of the retrievable vehicle 26.

Control is transferred from block 1330 of FIG. 13 to block 1335, where a determination is made as to whether the homing path 174 of the intercepting vehicle 20 is substantially aligned with the predetermined path 170 of the retrievable vehicle 26. In accordance with the first embodiment of the present invention, the homing path 174 of the intercepting vehicle 20 is deemed to be substantially aligned with the predetermined path 170 of the retrievable vehicle 26 if these paths are sufficiently aligned to provide a reasonably high likelihood of a successful docking of the intercepting vehicle 20 and the retrievable vehicle 26 to one another, as will be discussed in greater detail below. If it is determined at block 1335 that the homing path 174 of the intercepting vehicle 20 is substantially aligned with the predetermined path 170 of the retrievable vehicle 26, then control is transferred to block 1345, which will be discussed in greater detail below.

Figure 15:
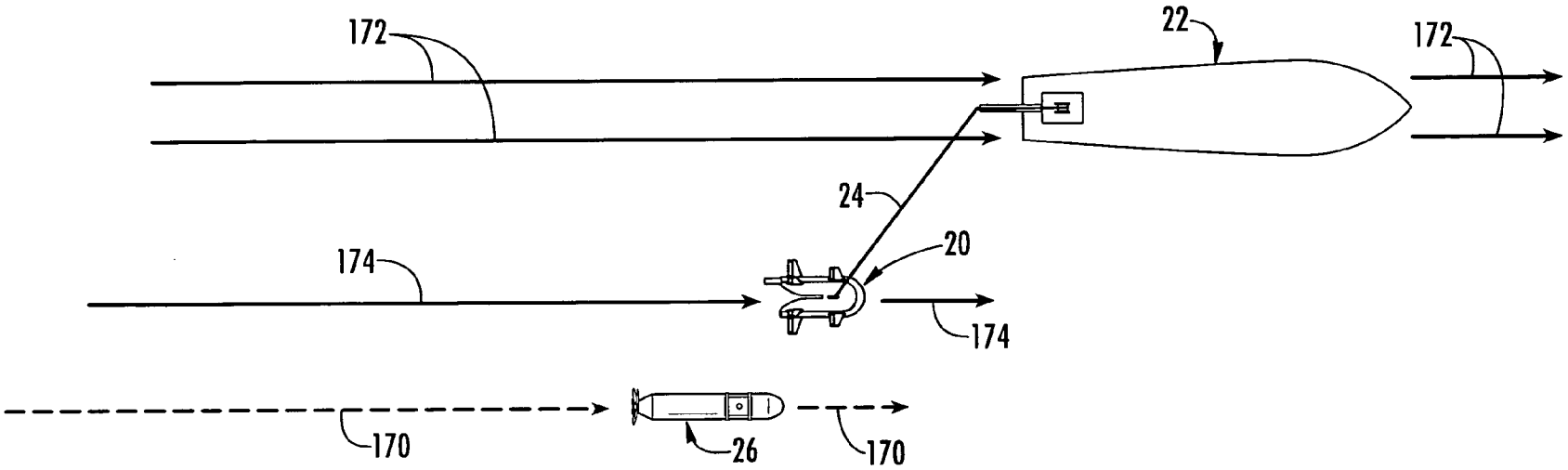
FIG. 15 is a schematic, top view showing the paths of the towing vehicle and the intercepting vehicle not aligned with the predetermined path of the retrievable vehicle, in accordance with the exemplary method of the first embodiment of the present invention.

As best understood with reference to FIG. 15, if it is determined at block 1335 of FIG. 13 that the homing path 174 of the intercepting vehicle 20 is not substantially aligned with the predetermined path 170 of the retrievable vehicle 26, then control is transferred to block 1340. In accordance with a first example of actions that may be taken at block 1340, the actions are taken to at least more generally align the predetermined path 170 of the retrievable vehicle 26 and the coincident path 172 of the towing vehicle 22, in an effort to enable the homing path 174 of the intercepting vehicle 20 to become substantially aligned with the predetermined path 170 of the retrievable vehicle 26. In accordance with the exemplary method of the first embodiment, one or more methods and mechanisms may be used alone or in combination to carry out the operations associated with blocks 1335 and 1340. As one example, the predetermined path 170 of the retrievable vehicle 26 and the homing path 174 of the intercepting vehicle 174 may be detected and observed using one or more components (e.g., a sonar that uses acoustic signals) of the operational components 162*a-n* (FIG. 12) of the towing vehicle 22, and based upon those observances respective operations associated with blocks 1335 and 1340 may be carried out (e.g., the towing vehicle 22 may be steered in an effort to more closely align the predetermined path 170 of the retrievable vehicle 26 and the coincident path 172 of the towing vehicle 22).

Figure 17:
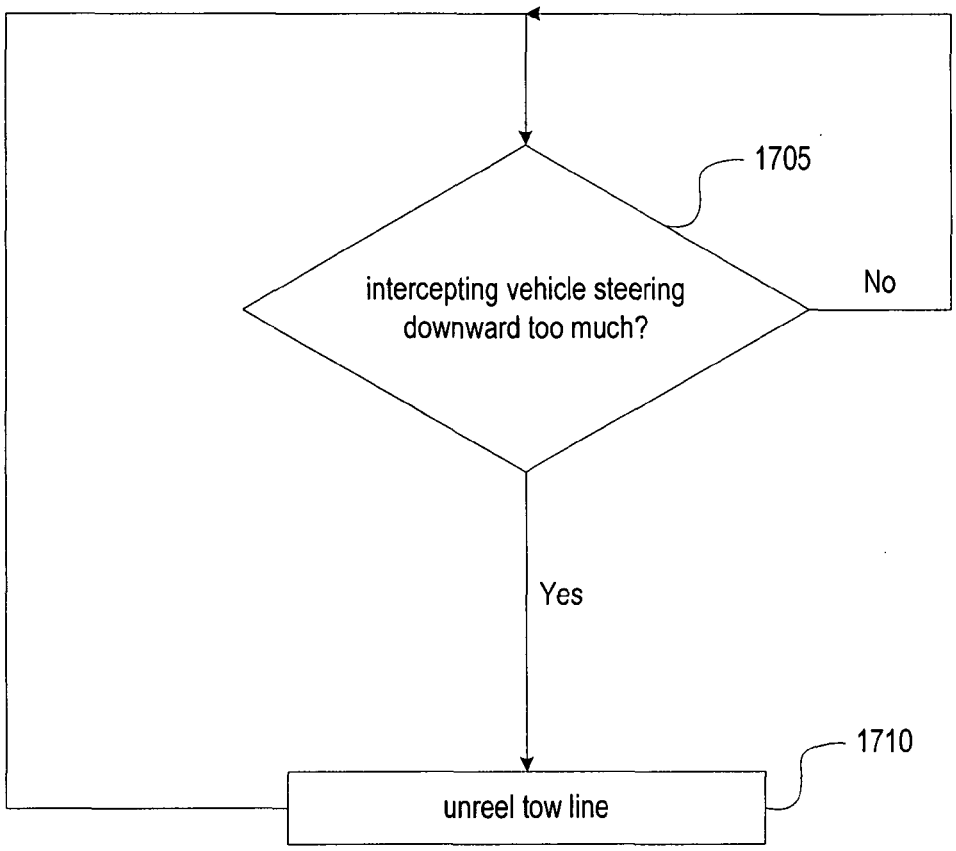
FIG. 17 is a block diagram that schematically illustrates operations, steps, structures and/or software modules, or the like, associated with operating the towing vehicle in a depth adjustment mode in an effort to at least more generally align a homing path of the intercepting vehicle with the predetermined path of the retrievable vehicle, in accordance with the exemplary method of the first embodiment of the present invention.
Figure 18:
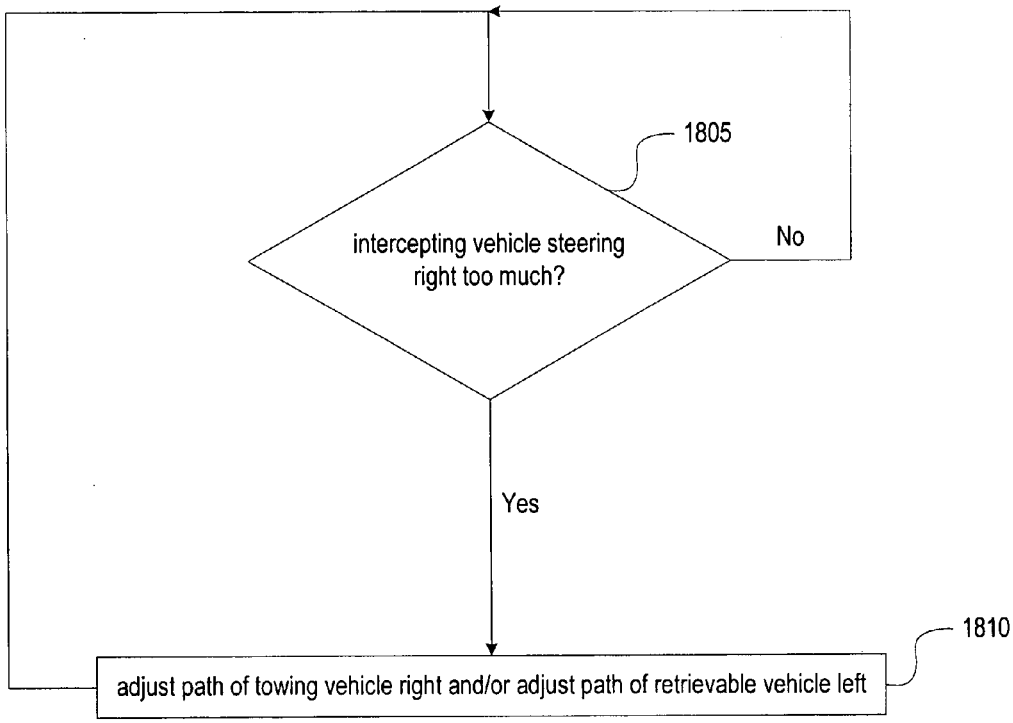
FIG. 18 is a block diagram that schematically illustrates operations, steps, structures and/or software modules, or the like, associated with operating the towing vehicle and/or the retrievable vehicle in a right adjustment mode in an effort to at least more generally align the predetermined path of the retrievable vehicle and the coincident path of the towing vehicle with one another, in an effort to enable the homing path of the intercepting vehicle to become substantially aligned with the predetermined path of the retrievable vehicle, in accordance with the exemplary method of the first embodiment of the present invention.
Figure 19:
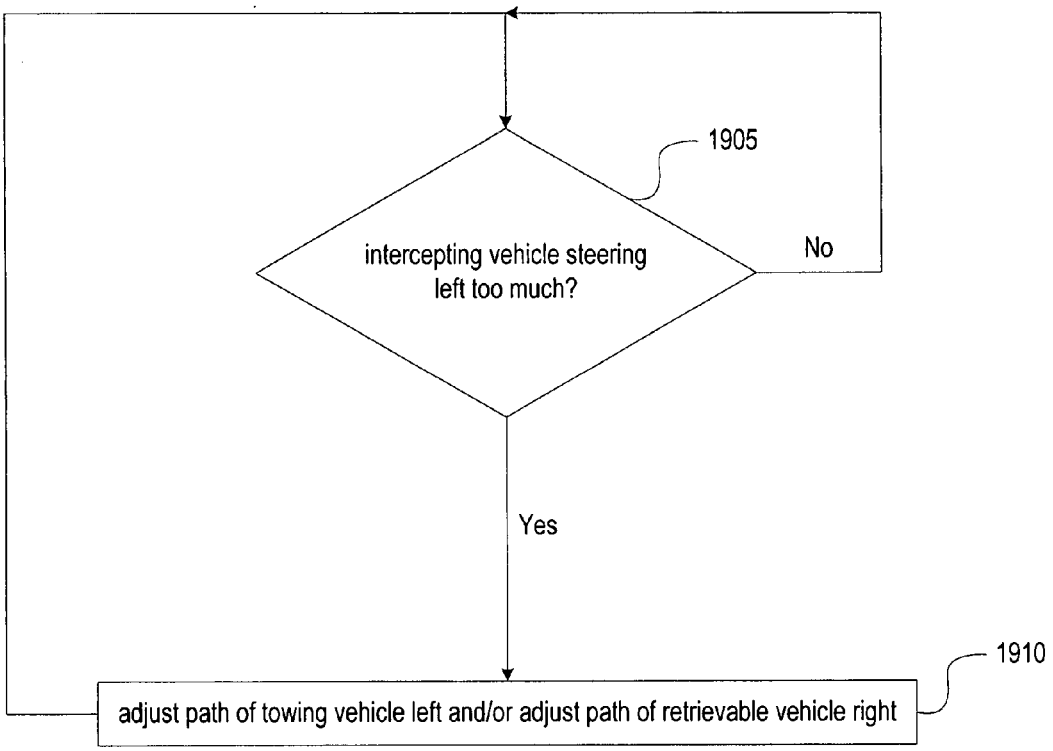
FIG. 19 is a block diagram that schematically illustrates operations, steps, structure and/or software modules, or the like, associated with operating the towing vehicle and/or the retrievable vehicle in a left adjustment mode in an effort to at least more generally align the predetermined path of the retrievable vehicle and the coincident path of the towing vehicle with one another, in an effort to enable the homing path of the intercepting vehicle to become substantially aligned with the predetermined path of the retrievable vehicle, in accordance with the exemplary method of the first embodiment of the present invention.

Alternatively or in addition, FIGS. 17-19 present block diagrams (e.g., flow diagrams) that schematically illustrate operations, steps, structures and/or software modules, or the like, associated with blocks 1335 and 1340 of FIG. 13. Generally described, the aspects of FIGS. 17-19 relate to making any necessary adjustments that may be needed to allow the homing path 174 of the intercepting vehicle 20 to become substantially aligned with the predetermined path 170 of the retrievable vehicle 26. However, it is to be understood that some aspects of the first embodiment of the present invention are optional and may be omitted. For example, the aspects of the first embodiment of the present invention that are schematically illustrated by FIGS. 17-19 may be omitted, for example, if a sufficient length of the tow line 24 is initially provided and operations associated with blocks 1305 and 1310 of FIG. 13 are carried out such that the coincident path 172 of the towing vehicle 22 substantially coincides (e.g., in a top plan view) with the predetermined path 170 of the retrievable vehicle 26. For example, it may be typical to initially provide a sufficient length of the tow line 24 so that the intercepting vehicle 20 may descend sufficiently far without the possibility of later needing to further unreel the tow line 24 (e.g., so that the block diagram of FIG. 17 may be omitted). As best understood with reference to FIG. 12, initially providing more than an adequate length of tow line 24 that extends from the towing vehicle 22 to the intercepting vehicle 20 can help to minimize (e.g., dampen) the impact that waves at the surface 150 of the body of water 152 might have upon the homing path 174 of the intercepting vehicle 20. On the other hand, there may be situations in which it might be desirable to minimize the length of the tow line 24 that extends from the towing vehicle 22 to the intercepting vehicle 20, perhaps such as when there may be excessive underwater currents or excessive obstructions (e.g., excessive seaweed) in the body of water 152.

Referring to FIGS. 17-19, at blocks 1705, 1805 and 1905, determinations are respectively made as to whether the intercepting vehicle 20 is steering downward, to the right and to the left too much, as a result of operating in the homing mode that was initiated at block 1330. If the intercepting vehicle 20 is steering downward, to the right or to the left too much in its efforts to home in on the retrievable vehicle 26, then there is a reasonably high probability that the intercepting vehicle 20 will not be able to reach (i.e., is constrained from reaching) the predetermined path 170 of the retrievable vehicle 26 in a manner so that the homing path 174 of the intercepting vehicle 20 can be substantially aligned with the predetermined path 170 of the retrievable vehicle 26.

As mentioned above and in accordance with the first embodiment of the present invention, while the intercepting vehicle 20 is operating in the homing mode, it automatically steers itself in an effort to cause the homing path 174 of the intercepting vehicle 20 to become aligned with the predetermined path 170 of the retrievable vehicle 26, and this steering is carried out through the use of one or more of (e.g., the computer of) the operational components 96*a-n* of the intercepting vehicle 20 operating in conjunction with (e.g., respectively providing instructions to) the steering mechanisms 94 (e.g., see FIGS. 8 and 9) of the intercepting vehicle 20. In this regard and further to operations at blocks 1705, 1805 and 1905, the one or more of (e.g., the computer of) the operational components 96*a-n* of the intercepting vehicle 20 that are for providing signals responsible for controlling the steering may also provide signals that report on the steering of the intercepting vehicle 20, such as from one or more of (e.g., a communication transmitter or transceiver of) the operational components 96*a-n* of the intercepting vehicle 20 to one or more of (e.g., a communication receiver or transceiver of) the operational components 162*a-n* of the towing vehicle 22. For example and respectively, the intercepting vehicle 20 may be steering downward, right or left too much if one or more of the steering mechanisms 94 of the intercepting vehicle 20 are steering downward, right or left more than a predetermined amount for more than a predetermined time and/or if one or more of the steering mechanisms 94 of the intercepting vehicle 20 are steering downward, right or left to their full extent.

Referring to FIG. 17, if it is determined at block 1705 that the intercepting vehicle 20 is steering downward too much, then control is transferred to block 1710. At block 1710, the winch 158 (FIG. 12) is operated (e.g., under the control of one or more of (e.g., a computer of) the operational components 162*a-n* of the towing vehicle 22) to further unreel the tow line 24, so that a greater length of the tow line 24 is between the towing vehicle 22 and the intercepting vehicle 20, so that the intercepting vehicle is capable of further descending. Alternatively at block 1705, rather than or in addition to unreeling the tow line 24, instructions may be provided to the retrievable vehicle 26 so that the depth of the predetermined path 170 of the retrievable vehicle 26 is decreased. Either way, the adjustment(s) made at block 1710 are carried out in a manner that seeks to cause the predetermined path 170 of the retrievable vehicle 26 to be within the range of the intercepting vehicle 20, so that the intercepting vehicle 20 can steer itself so that the homing path 174 of the intercepting vehicle 20 can be substantially aligned with the predetermined path 170 of the retrievable vehicle 26. In accordance with the exemplary method of the first embodiment of the present invention, only the length of the tow line 24 is adjusted at block 1710, and operation of the retrievable vehicle 26 is steady state (e.g., typically intentional adjustments are not made to the depth of the predetermined path 170 of the retrievable vehicle 26 after the predetermined path 170 is initially established at block 1305 of FIG. 13). The adjustment to the length of the tow line 24 may be either manually controlled or automatically controlled.

Control is transferred from block 1710 to block 1705, and if it is determined at block 1705 that the intercepting vehicle 20 is not steering downward too much, then control remains/loops back to block 1705 in a do-loop like fashion, so that it is substantially continuously determined whether the intercepting vehicle 20 is steering downward too much while the intercepting vehicle 20 is operating in the homing mode initiated at block 1330 of FIG. 13.

Respectively referring to FIGS. 18 and 19, if it is determined at block 1805 of FIG. 18 that the intercepting vehicle 20 is steering right too much, then control is transferred to block 1810; and if it is determined at block 1905 of FIG. 19 that the intercepting vehicle 20 is steering left too much, then control is transferred to block 1910. At blocks 1810 and 1910, adjustments are made to the steering of the towing vehicle 22 and/or retrievable vehicle 26 in an effort to cause the coincident path 172 of the towing vehicle 22 and the predetermined path 170 of the retrievable vehicle 26 to better coincide with one another in a top plan view, so that the intercepting vehicle 20 is capable of steering itself so that the homing path 174 of the intercepting vehicle 20 can be substantially aligned with the predetermined path 170 of the retrievable vehicle 26. In accordance with the exemplary method of the first embodiment of the present invention, only the steering of the towing vehicle 22 is adjusted at blocks 1810 and 1910 and operation of the retrievable vehicle 26 is typically steady state (e.g., typically intentional adjustments are not made to direction(s) of the predetermined path 170 of the retrievable vehicle 26 after the predetermined path 170 is initially established at block 1305 of FIG. 13). Therefore and in accordance with the exemplary method of the first embodiment of the present invention, if it is determined at block 1805 of FIG. 18 that the intercepting vehicle 20 is steering right too much, then control is transferred to block 1810, and at block 1810 the towing vehicle 22 is, for example, at least steered to the right, to shift the coincident path 172 of the towing vehicle 22 to the right in a manner that seeks to place predetermined path 170 of the retrievable vehicle 26 within the range of the intercepting vehicle 20, so that the intercepting vehicle 20 can steer itself so that the homing path 174 of the intercepting vehicle 20 can be substantially aligned with the predetermined path 170 of the retrievable vehicle 26. Similarly and in accordance with the exemplary method, if it is determined at block 1905 of FIG. 19 that the intercepting vehicle 20 is steering left too much, then control is transferred to block 1910, and at block 1910 the towing vehicle 22 is, for example, at least steered to the left, to shift the coincident path 172 of the towing vehicle 22 to the left in a manner that seeks to place predetermined path 170 of the retrievable vehicle 26 within the range of the intercepting vehicle 20, so that the intercepting vehicle 20 can steer itself so that the homing path 174 of the intercepting vehicle 20 can be substantially aligned with the predetermined path 170 of the retrievable vehicle 26. The adjustments to the steering of the towing vehicle 22 that are made at blocks 1810 and 1910 can be made by manually controlling and/or automatically controlling the steering of the towing vehicle 22.

Referring to FIG. 18, control is transferred from block 1810 to block 1805, and if it is determined at block 1805 that the intercepting vehicle 20 is not steering right too much, then control remains/loops back to block 1805 in a do-loop like fashion, so that it is substantially continuously determined whether the intercepting vehicle 20 is steering right too much while the intercepting vehicle 20 is operating in the homing mode initiated at block 1330 of FIG. 13. Similarly and referring to FIG. 19, control is transferred from block 1910 to block 1905, and if it is determined at block 1905 that the intercepting vehicle 20 is not steering left too much, then control remains/loops back to block 1905 in a do-loop like fashion, so that it is substantially continuously determined whether the intercepting vehicle 20 is steering left too much, while the intercepting vehicle 20 is operating in the homing mode initiated at block 1330 of FIG. 13.

For example, throughout this Detailed Description section of this disclosure, in the exemplary methods of the first embodiment of the present invention where manual adjustments are made to the speed of the towing vehicle 22 or direction of the coincident path 172 of the towing vehicle 22 (e.g., respectively at blocks 1325, 1340, 1810 and 1910), they may be made at least partially in view of (e.g., in response to a user visually analyzing) one or more images on a video display that is one of, or for example a portion of a computer of, the operational components 162*a-n* that are carried by the towing vehicle 22. For example, the image(s) on the video display may show the relative positions and/or changes in the relative positions of the intercepting vehicle 20 and the retrievable vehicle 26, such as in the format of a schematic top plan view. Similarly and as an additional example for optionally being used in adjusting the length of the tow line 24, the image(s) on the video display may show a schematic representation of the relative positions and/or changes in the relative positions of the intercepting vehicle 20 and the retrievable vehicle 26, such as in the format of a side elevation view. In addition, the positions/relative positions of the towing vehicle 22 and the tow line 24 may be superposed on the image(s) on the video display, such that the images on the video display may be generally or substantially like that which is shown in FIGS. 12, 14 and 15 or portions thereof. In addition, the video display may display additional information that is indicative about how far the intercepting vehicle 20 is steering up, down, right and left. As a result, an operator that is either directly or remotely manually operating the towing vehicle 22 and is observing the above-discussed images can manually operate the towing vehicle 22 accordingly (e.g., as described above and below). The image(s) provided on the video display may be developed and provided, for example, through the use of one or more of (e.g., the computer of) the operational components 96*a-n* of the intercepting vehicle 20 operating in conjunction with the homing transceiver 72 of the intercepting vehicle 20, while the homing transceiver 72 of the intercepting vehicle 20 operates in conjunction with the homing beacon 147 of the retrievable vehicle 26, a sonar device of the operational components 162*a-n* of the towing vehicle 22, and/or by way of any other suitable methods or mechanisms.

Referring back to FIG. 13, when it is determined at block 1335 that the homing path 174 of the intercepting vehicle 20 is substantially aligned with the predetermined path 170 of the retrievable vehicle 26, then control is transferred to block 1345. At block 1345, the system (e.g., the towing vehicle 22) stops operating in the first relative position mode, which was initiated at block 1315 and is intended to temporarily maintain the intercepting vehicle 20 a predetermined distance ahead of the retrievable vehicle 26. Also at block 1345, operation of the towing vehicle 22 and/or retrievable vehicle 26 in the second relative position mode is initiated in an effort to allow the retrievable vehicle 26 to catch up to and dock with the intercepting vehicle 20. In accordance with the exemplary method of the first embodiment of the present invention, only the towing vehicle 22 is operated in the second relative position mode, and operation of the retrievable vehicle 26 is steady state (e.g., typically intentional adjustments are not made to the predetermined path 170 of the retrievable vehicle or the speed at which the retrievable vehicle 26 travels along the predetermined path 170).

In accordance with the first embodiment of the present invention, the intercepting vehicle 20 continues to operate in the homing mode, which was initiated at block 1330, while the towing vehicle 22 operates in the second relative position mode, which was initiated at block 1345. As a result, generally described and typically, the intercepting vehicle 20 automatically steers itself (while it is being towed by the towing vehicle 22 and it is in front of the retrievable vehicle 26) substantially in the predetermined path 170 of the retrievable vehicle 26 by homing in on the retrievable vehicle 26 while the towing vehicle 22 and the intercepting vehicle 20 are traveling at a slower speed than the retrievable vehicle 26, that the retrievable vehicle 26 catches up to the intercepting vehicle 20 from behind, and the retrievable vehicle 26 becomes docked to the intercepting vehicle 20, as will be discussed in greater detail below. More specifically and in accordance with the exemplary method of the first embodiment of the present invention, the docking is a multiphase process, and provisions are made to compensate for a possible situation in which the retrievable vehicle 26 inadvertently passes the intercepting vehicle 20 without docking to it. Such a missed docking opportunity may occur, for example, due to sudden changes with any currents, waves or other conditions associated with the body of water 152 or other mediums in which the system is operating.

In FIG. 13, control is transferred from block 1345 to blocks 1350 and 1360. At block 1350 a determination is made as to whether the retrievable vehicle 26 has passed the intercepting vehicle 20, such that it will not be possible for these vehicles to become docked to one another with continued operation of the towing vehicle 22 in the second relative position mode (which was initiated at block 1345). At block 1360, a determination is made as to whether the retrievable vehicle 26 has become initially latched to the intercepting vehicle 20, as part of the multi-part docking process of the first embodiment of the present invention. For each of blocks 1350 and 1360, if a negative determination is made, then control respectively remains at the blocks 1350 and 1360 in a do-loop like fashion, so that the system respectively operates in a fault detection mode (which comprises block 1350) and a latching detection mode (which comprises block 1360), until control is respectively transferred away from the blocks 1350 and 1360, as discussed in greater detail below.

If it is determined at block 1350 that the retrievable vehicle 26 has passed the intercepting vehicle 20, such that it will not be possible for these vehicle to become docked to one another while the towing vehicle 22 operates in the second relative position mode (which was initiated at block 1345), then control is transferred to block 1355. At block 1355, each of the homing mode (which was initiated at block 1330), the second relative position mode (which was initiated at block 1345) and the latching detection mode (which comprises block 1360) are terminated, and control is transferred back to block 1315.

If it is determined at block 1360 that the retrievable vehicle 26 has become initially latched to the intercepting vehicle 20, as part of the multi-part docking of the first embodiment of the present invention, then control is transferred to block 1363. In accordance with the first embodiment of the present invention, typically the retrievable vehicle 26 becomes initially latched to the intercepting vehicle 20 shortly after control is transferred to/in response to control being transferred to block 1345. Typically the initial latching occurs while the retrievable vehicle 26 is traveling along a substantially straight section of the predetermined path 170 at a substantially constant depth. That is, the predetermined path 170 of the retrievable vehicle 26 typically includes at least a segment along which the retrievable vehicle 26 is traveling along a substantially straight line at a substantially constant depth, although variations are within the scope of the present invention.

Figure 20:
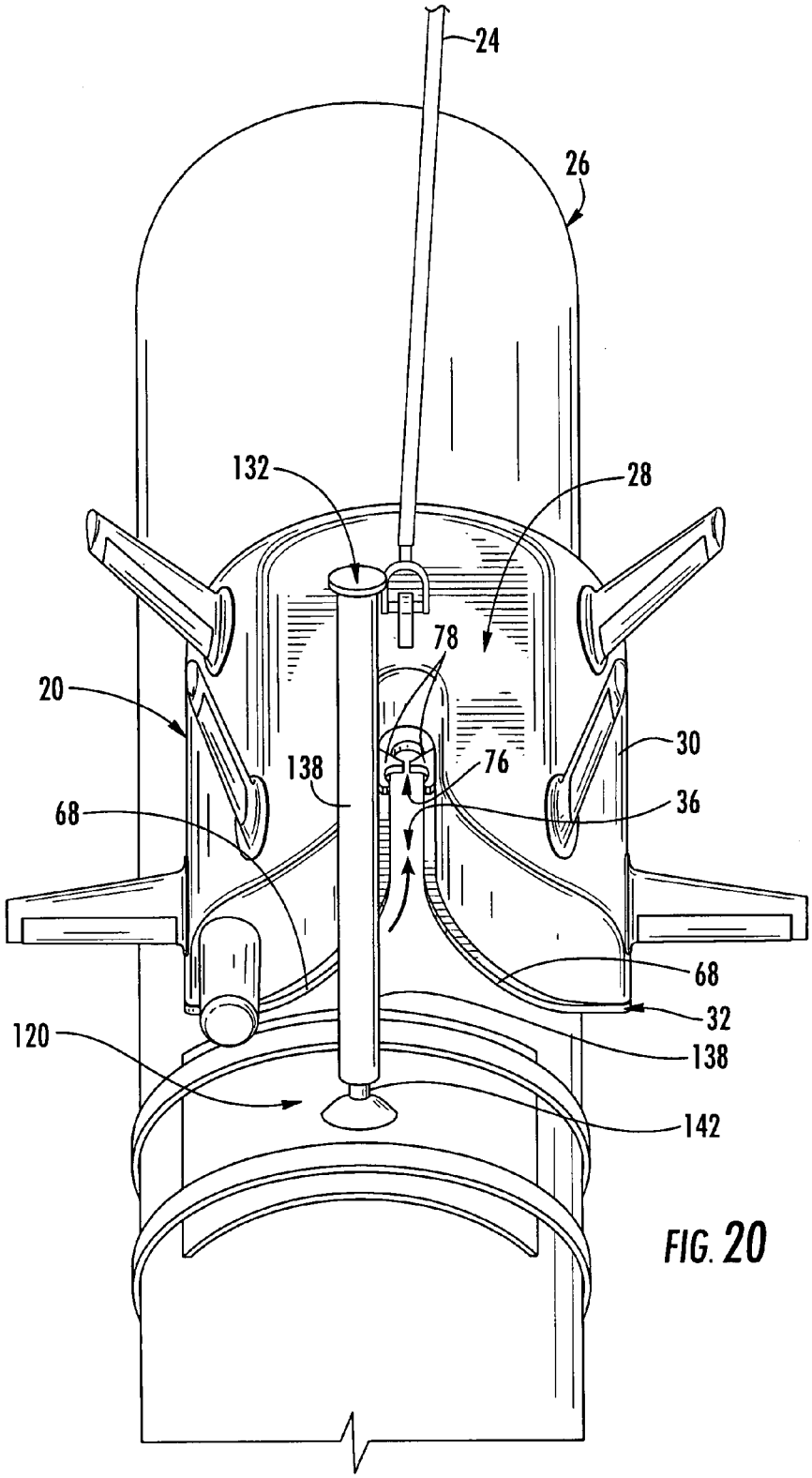
FIG. 20 is a partial, schematic, rear/top perspective view showing the retrievable vehicle catching up to the intercepting vehicle from behind, so that a docking pole of the docking apparatus, which is carried by the retrievable vehicle, enters the rear of a receptacle slot defined in the intercepting vehicle, in accordance with the exemplary method of the first embodiment of the present invention.

FIG. 20 is a partial, schematic, rear/top perspective view showing the retrievable vehicle 26 catching up to the intercepting vehicle 20 from behind, so that the docking pole 132 of the docking apparatus 120 enters the rear of the receptacle slot 36 of the intercepting vehicle 20. FIG. 20 illustrates a portion of the system of the first embodiment of the present invention in a state that typically occurs shortly after control is transferred to/in response to control being transferred to block 1345, and shortly before the retrievable vehicle 26 becomes initially latched to the intercepting vehicle 20. As best understood with reference to FIG. 20 and in accordance with the exemplary method of the first embodiment of the present invention, during the early stages of the docking of the retrievable vehicle 26 to the intercepting vehicle 20, the intermediate section 138 of the docking pole 132 enters the receptacle slot 36 from the rear, and the docking flange 68 of the lower plate 32 guides the intermediate section 138 of the docking pole 132 forwardly toward the latch 76 that is located at the forward end of the receptacle slot 36. The enlarged rear portion of the receptacle slot 36 provides a relatively large target for receiving the docking pole 132 and the shape of the receptacle slot 36 helps to "funnel" the docking pole 132 into the receptacle slot 36. The relative thinness of the lower plate 32/docking flange 68, and the protruding of the docking flange 68 into the receptacle slot 36 help to maximize the likelihood of the docking pole 132 being optimally received in the receptacle slot 36.

Typically, although not necessarily, all of the contact between the docking pole 132 and the body 28 of the intercepting vehicle 20 will occur at the lower plate 32/docking flange 68. That is, typically, the docking pole 132 contacts the lower plate 32/docking flange 68 rather than the shell 30 of the intercepting vehicle. In accordance with the first embodiment of the present invention, when the docking pole 132 contacts the docking flange 68 of the lower plate 32, the system is operating in the second relative position mode initiated at block 1345 of FIG. 13 and the relative difference in speed between the intercepting vehicle 20 and the retrievable vehicle 26 is typically not so great to cause any meaningful damage to either the intercepting vehicle 20 or the retrievable vehicle 26; however, the relative difference in speed between the intercepting vehicle 20 and the retrievable vehicle 26 is sufficiently great to mechanically actuate the latch 76 when the docking pole 132 engages the latch 76, as will be discussed in greater detail below.

In accordance with the first embodiment of the present invention, the docking pole 132, lower plate 32 and latch 76 are constructed of material that is sufficiently mechanically strong so as typically not to be significantly damaged by the contact between the docking pole 132 and the lower plate 32 and latch 76. For example, they each may be constructed of metal, such as steel, although they may be constructed of other materials. In contrast and for example, the shell 30 of the intercepting vehicle 20 may be made of polymer material or reinforced polymer material, in an effort for the intercepting vehicle 20 to be relatively light weight and, therefore, easy to manually deploy. On the other hand, in situations where greater strength may be required, the shell 30 of the intercepting vehicle 20 may be made of metal, such as steel, or any other suitable material. Similarly, the pads 82 can be made of polymer material or reinforced polymer material, or they could be made of metal, such as steel, or any other suitable material.

Figure 21:
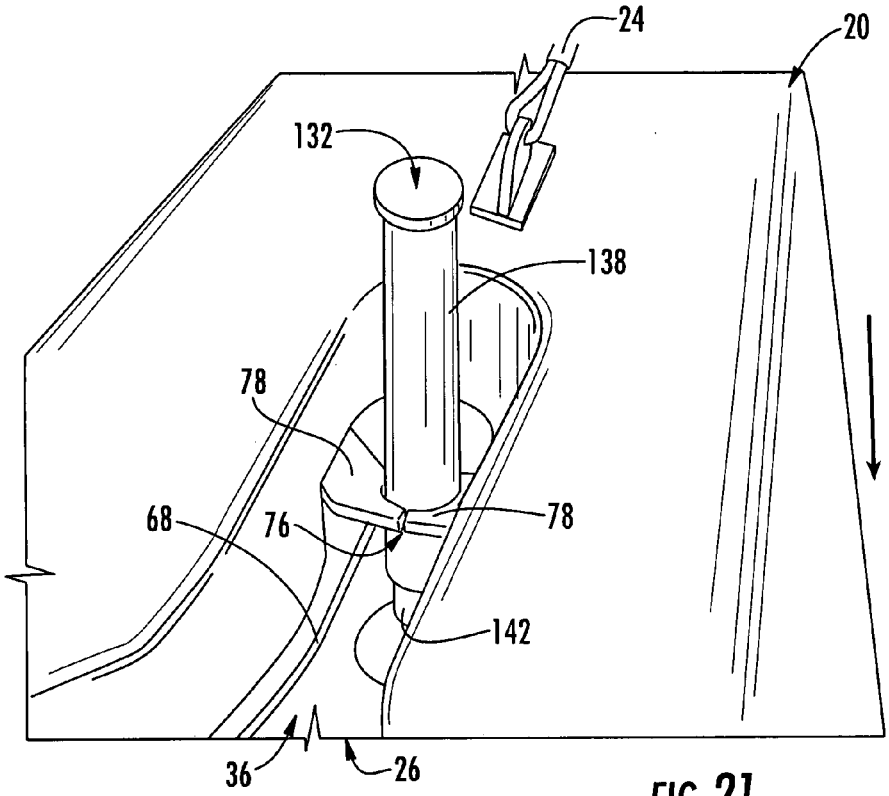
FIG. 21 is a partial, schematic, rear/top perspective view showing the retrievable vehicle initially latched/docked to the intercepting vehicle, wherein the retrievable vehicle and the intercepting vehicle are in a relatively loosely docked state with respect to one another, in accordance with the exemplary method of the first embodiment of the present invention.

As alluded to above with reference to FIG. 20 and in accordance with the exemplary method of the first embodiment of the present invention, the docking pole 132 is guided forwardly by the docking flange 68 so that the docking pole 132 engages the open clasps 78 of the latch 76 (e.g., engages the clasp's arms that initially protrude into the receptacle slot 36) with sufficient force to cause the clasps 78 to close on and grasp the intermediate section 138 of the docking pole 132 to provide an initially latched configuration shown in FIG. 21. The latch 76 can be characterized as being partially closed in FIG. 21. Whereas the system is typically operated in a manner that seeks to cause the latch 76 to become initially latched to the middle of the intermediate section 138 of the docking pole 132, the latch 76 may become initially latched to any portion of the docking pole 132 that is between the enlarged section 140 and the indented section 142 of the docking pole 132. Once the system is in the initially latched configuration shown in FIG. 21, the docking pole 132 is restricted from sliding out of the closed latch 76 because, for example, the upper surfaces of the clasps 78 would engage the upper shoulder 144 (FIG. 11) of the enlarged section 140 of the docking pole 132.

In accordance with the first embodiment of the present invention, the latch 76 is a bear claw type of latch, although other types of capturing mechanisms (e.g., other types of latches) that functional suitably may be used. For example, the bear claw type of latch 76 can include ratchets (not shown)

and pawls (not shown). The ratchets may be respectively mounted for rotating with the clasps 78, and the pawls may be adapted for respectively interacting with the ratchets for restricting the clasps 78 from moving from their initially and fully closed configurations (see FIGS. 21 and 22, respectively) to their open configurations (e.g., see FIG. 20). Also, a release mechanism (not shown), which may, for example, be actuated by a manually pressable button (not shown) may be provided for releasing the pawls from the ratchets so that the bear claw type of latch 76 may be opened, such as after reeling in/retrieving the intercepting vehicle 20 and the retrievable vehicle 26, as will be discussed in greater detail below. Further regarding the release mechanism associated with the latch 76, this release mechanism may be remotely operated, for example, if the intercepting vehicle 20 is used to deploy/release the vehicle 26, and such a released vehicle is not required to be subsequently retrievable, although it may be retrievable as described herein.

Referring back to FIG. 13, at block 1360 a determination is made as to whether the retrievable vehicle 26 has become initially latched to the intercepting vehicle 20, for example in the manner schematically shown in FIG. 21. In accordance with the first embodiment of the present invention, this determination that is made at block 1360 may be made using the one or more latch sensors 92 (FIG. 8) or any other suitable methods and/or mechanisms. When a positive determination is made a block 1360, control is transferred to block 1363. At block 1363, the homing mode of the intercepting vehicle 20, which is initiated at block 1330, is terminated, and operation of the system in the fault detection mode, which comprises block 1350, is terminated. Operation of the intercepting vehicle 20 in a descent mode is initiated at block 1363. In the descent mode, steering mechanisms 94 of the intercepting vehicle 20 are automatically operated, in response to the determination that the retrievable vehicle 26 has become initially latched to the intercepting vehicle 20, so that the intercepting vehicle 20 descends relative to the retrievable vehicle 26. In accordance with the exemplary method of the first embodiment of the present invention, the steering mechanisms 94 are operated in the descent mode so that the plane of the lower plate 32 of the intercepting vehicle 20 remains substantially perpendicular to the elongate axis of the docking pole 132 (e.g., the lower plate 32 remains substantially horizontal) in a manner that seeks to ensure a smooth transition from the configuration shown in FIG. 21 to the configuration shown in FIG. 22.

Control is transferred from block 1363 of FIG. 13 to block 1365. At block 1365, a determination is made as to whether the retrievable vehicle 26 is finally latched to the intercepting vehicle 20 in the manner schematically shown in FIG. 22. If it is determined at block 1365 that the retrievable vehicle 26 has not yet finally latched to the intercepting vehicle 20, then control remains/loops back to block 1365 in a do-loop like fashion, so that it is substantially continuously determined whether the retrievable vehicle 26 has finally latched to the intercepting vehicle 20. In accordance with the first embodiment of the present invention, the determination that is made at block 1365 may be made using the one or more latch sensors 92 (FIG. 8) or any other suitable methods and/or mechanisms.

Figure 22:
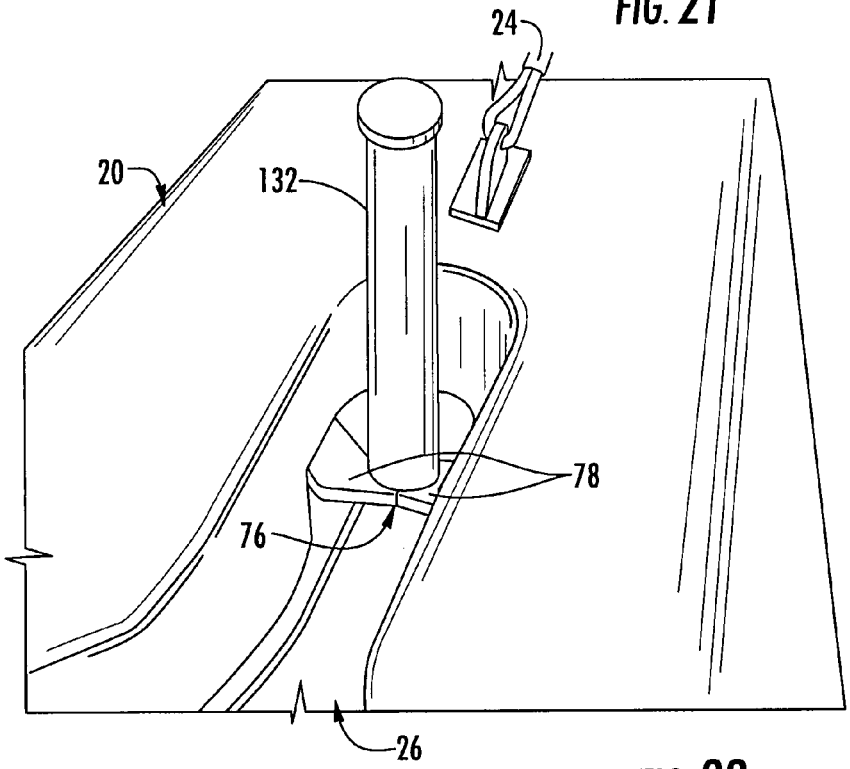
FIG. 22 is a partial, schematic, rear/top perspective view showing the retrievable vehicle finally latched/docked to the intercepting vehicle, wherein the retrievable vehicle and the intercepting vehicle are in a relatively tightly docked state with respect to one another, in accordance with the exemplary method of the first embodiment of the present invention.

FIG. 22 is a partial, schematic, rear/top perspective view showing the docking pole 132 of the retrievable vehicle 26 finally latched to the intercepting vehicle 20, in accordance with the first embodiment of the present invention. The latch 76 can be characterized as being farther closed in FIG. 22 than in FIG. 21. In accordance with the exemplary method of the first embodiment of the present invention, the relatively tightly docked state shown in FIG. 22 is reached when the intercepting vehicle 20 descends far enough relative to the retrievable vehicle 26 so that the clasps 78 enter the indented section 142 of the docking pole 132. In accordance with the exemplary method, when the clasps 78 reach the indented section 142, the intercepting vehicle 20 is still operating in the second relative position mode (which was initiated at block 1345), so that the intercepting vehicle 20 seeks to travel faster in the forward direction than the retrievable vehicle 26; therefore, the clasps 78 close farther/move into the indented section 142 of the docking pole 132. While the clasps 78 extend into the indented section 142 of the docking pole 132, the upper surfaces of the clasps are in opposing face-to-face relation with, or more specifically opposing face-to-face contact with, the lower shoulder 146 (FIG. 11) of the docking pole 132. As a result, once the system is in the finally latched configuration shown in FIG. 22, the latch 76 is substantially restricted from moving along the docking pole 132 because of engagement between the upper surfaces of the clasps 78 and the lower shoulder 146 of the docking pole 132. That is, the docking pole 132 can be characterized as being more firmly grasped in FIG. 22 than in FIG. 21.

As mentioned above, some of the above-described features of the first embodiment of the present invention may be omitted. For example, it may be possible to omit the decision made at block 1365, because in some situations it may be appropriate to presume that the finally latched configuration will substantially always be reached after a short delay/predetermined period of time (e.g., after a few or several seconds) of the intercepting vehicle 20 being in the descent mode initiated at block 1363. As another example, in some situations, it is possible that the initially latched configuration shown in FIG. 21 will be skipped, in which case associated operations may be skipped. Also, in some situations, it may not be necessary to have both the relatively loosely docked state shown in FIG. 21 and the relatively tightly docked state shown in FIG. 22, such that one of these latched states and associated operations and features may be omitted.

Figure 23:
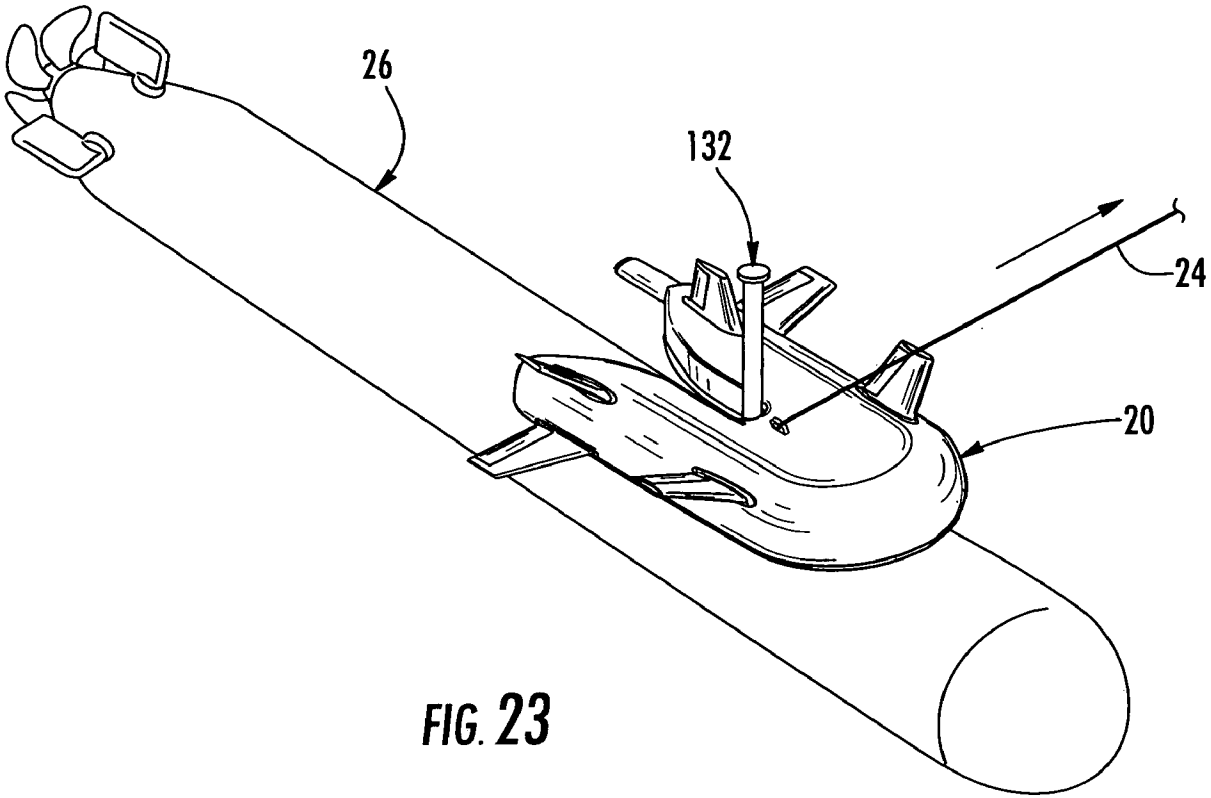
FIG. 23 is a perspective view of the retrievable vehicle and the intercepting vehicle in the relatively tightly docked state of FIG. 22, and it is schematically shown that the retrievable vehicle and the intercepting vehicle are being retrieved/reeled in by way of a tow line, in accordance with the exemplary method of the first embodiment of the present invention.

Referring back to FIG. 13, when it is determined at block 1365 that the docking pole 132 of the retrievable vehicle 26 is finally latched to the intercepting vehicle 20, so that the system is in the relatively tightly docked state shown in FIG. 22, control is transferred to block 1370. At block 1370, operation of the retrievable vehicle 26 in the predetermined mode, which was initiated at block 1305, is ceased. Also at block 1370, operation of the intercepting vehicle 20 in the descent mode, which was initiated at block 1363, is ceased. Control is transferred from block 1370 to block 1375. At block 1375, operation of the intercepting vehicle 20 in the coincident mode, which was initiated at block 1310, is ceased. Also at block 1375, the intercepting vehicle 20, with the retrievable vehicle 26 fully docked thereto so that the system is in the relatively tightly docked state shown in FIG. 22, is brought to the towing vehicle 22 by reeling in the tow line 24 by operating the winch 158 (FIG. 12) or by way of any other acceptable methods or mechanisms. For example, FIG. 23 is a perspective view of the retrievable vehicle 26 and the intercepting vehicle 20 in the relatively tightly docked state of FIG. 22, and it is schematically shown that these vehicles are being retrieved/reeled in by way of the tow line 24. After the intercepting and retrievable vehicles 20, 26 are reeled in, they may be lifted onto the deck of the towing vehicle 22 using the boom 156 or by way of any other acceptable methods or mechanisms. Then, the release mechanism (not shown) of the latch 76 may be used to release the latch from the docking pole 132, so that the intercepting vehicle 20 may be separated from the retrievable vehicle 26 and be reused, as will be discussed in greater detail below.

Figure 24:
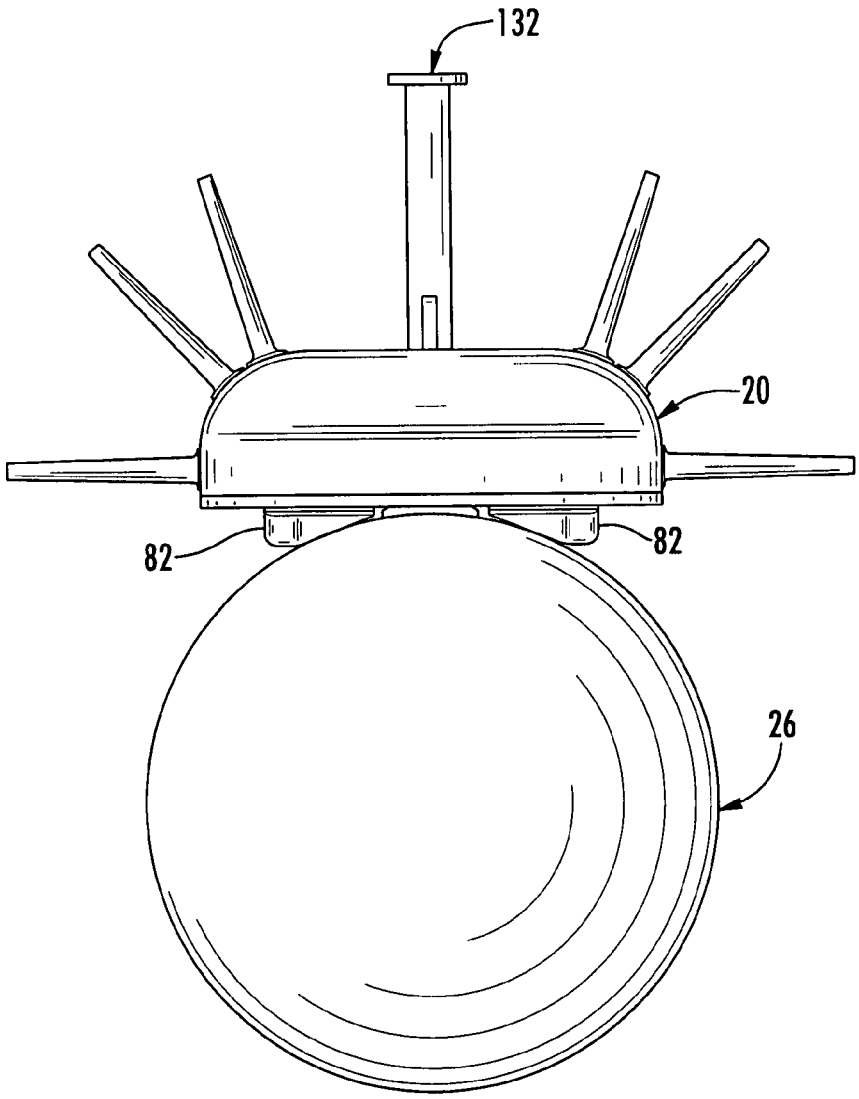
FIG. 24 is a front elevation view of the retrievable vehicle and the intercepting vehicle in the relatively tightly docked state of FIGS. 22 and 23.

FIG. 24 is a front elevation view of the retrievable vehicle 26 and the intercepting vehicle 20 in the relatively tightly docked state of FIGS. 22 and 23. As shown in FIG. 24 and in accordance with the exemplary method of the first embodiment, while the retrievable vehicle 26 and the intercepting vehicle 20 are in the relatively tightly docked state, the pads 82 (e.g., braces) mounted to the bottom of the intercepting vehicle are in opposing face-to-face contact with the hull of the retrievable vehicle 26, and the surfaces of the pads 82 that contact the hull of the retrievable vehicle 26 are contoured in a manner that is complementary to the contour of the hull of the retrievable vehicle 26. These features seek to ensure that the retrievable vehicle 26 is securely docked to the intercepting vehicle 20 in a manner that seeks to minimize (e.g., prevent) any relative movement between the retrievable vehicle 26 and the intercepting vehicle 20 during the relatively tightly docked state. As mentioned above and as will be discussed in greater detail below, the pads 82 are optional, and they may be replaced with a variety of differently shaped and/or sized pads 82 for allowing the intercepting vehicle 20 to be securely docked to a wide variety of differently sized and/or shaped retrievable vehicles 26.

The intercepting vehicle 20 can be a variety of different sizes. However and in accordance with the first embodiment of the present invention, the intercepting vehicle 20 is typically configured (e.g., sized) so that it is lightweight enough so that it can be manually lifted and deployed by one or two people. For example, as mentioned above with general reference to FIGS. 1-7 and accordance with the first embodiment of the present invention, the thickness of the vehicle body 28 of the intercepting vehicle 20 from top to bottom is smaller than both: the width of the vehicle body 28, which extends between the right and left sides of the vehicle body 28, and the length of the vehicle body 28, which extends between the front and rear ends of the vehicle body 28. In accordance with one acceptable example, the length of the vehicle body 28 is longer than the width of the vehicle body 28, and the length of the vehicle body 28 is between about two feet and about four feet, and more specifically the length of the vehicle body 28 is about three feet. More generally, the length of the vehicle body 28 is less than about four feet while being at least about a foot long, and even more generally the length of the vehicle body 28 is less than about five feet while being at least two feet long.

In accordance with the first embodiment of the present invention, due to the relatively small size of the vehicle body 28, the target area/width of the rear entry area of the receptacle slot 36 is relatively small. For example and as best understood with reference to FIGS. 2 and 6, the width of the rear entry area of the receptacle slot 36 may be measured from the outermost end of the right convex wall 44 of the receptacle slot 36 to the outermost end of the left convex wall 46 of the receptacle slot 36, and this width of the rear entry area may be in a range of about six inches to about two feet, or it may be in a range of about a foot to about three feet, although other widths are within the scope of the present invention. It may be desirable for the system of the first embodiment of the present invention to be usable in a wide variety of adverse conditions (e.g., in high waves, strong currents and strong winds); therefore, it is thought to be desirable for at least the maneuvering systems (e.g., steering mechanisms 94) and homing systems (e.g., homing transceiver 72 (FIG. 8) and homing beacon 147 (FIG. 11)) to operate sufficiently quickly to compensate for the potential adverse conditions and the relatively small size of the width of the rear entry area of the receptacle slot 36. For example, the homing systems of the first embodiment of the present invention may transmit/receive acoustic signals (e.g., pings) at different frequencies, in an effort to increase the homing accuracy and speed.

In one acceptable example and very generally described, the homing transceiver 72 transmits an acoustic ping having a first frequency, and the homing beacon 147 transmits an acoustic ping having a second frequency in response to receiving the ping having the first frequency; shortly after transmitting the ping having the first frequency, the homing transceiver 72 transmits an acoustic ping having a third frequency, and the homing beacon 147 transmits an acoustic ping having a fourth frequency in response to receiving the ping having the third frequency; shortly after transmitting the ping having the third frequency, the homing transceiver 72 transmits an acoustic ping having a fifth frequency, and the homing beacon 147 transmits an acoustic ping having a sixth frequency in response to receiving the ping having the fifth frequency; and shortly after transmitting the ping having the fifth frequency, the homing transceiver 72 transmits an acoustic ping having a seventh frequency, and the homing beacon 147 transmits an acoustic ping having an eighth frequency in response to receiving the ping having the seventh frequency. The homing transceiver 72 receives the pings of different frequencies from the homing beacon 147 and respectively correlates them to the pings of different frequencies that it transmitted as part of the process of homing in on the retrievable vehicle 26. The serial and rapid transmission of the pings of different frequencies increases the speed and accuracy of the homing. Whereas the above-described multi-frequency homing system has been described in the context of a certain number of pings of different frequency, other numbers of pings of different frequency are within the scope of the present invention. In addition, other methods and mechanisms may be used for optimizing the speed and accuracy of the homing. Alternatively, the width of the rear entry area of the receptacle slot 36 and other features of the first embodiment of the present invention may be sized to accommodate for the operational demands of the system without requiring the above-described multi-frequency homing system, so that a more conventional homing system may be used.

Figure 25:
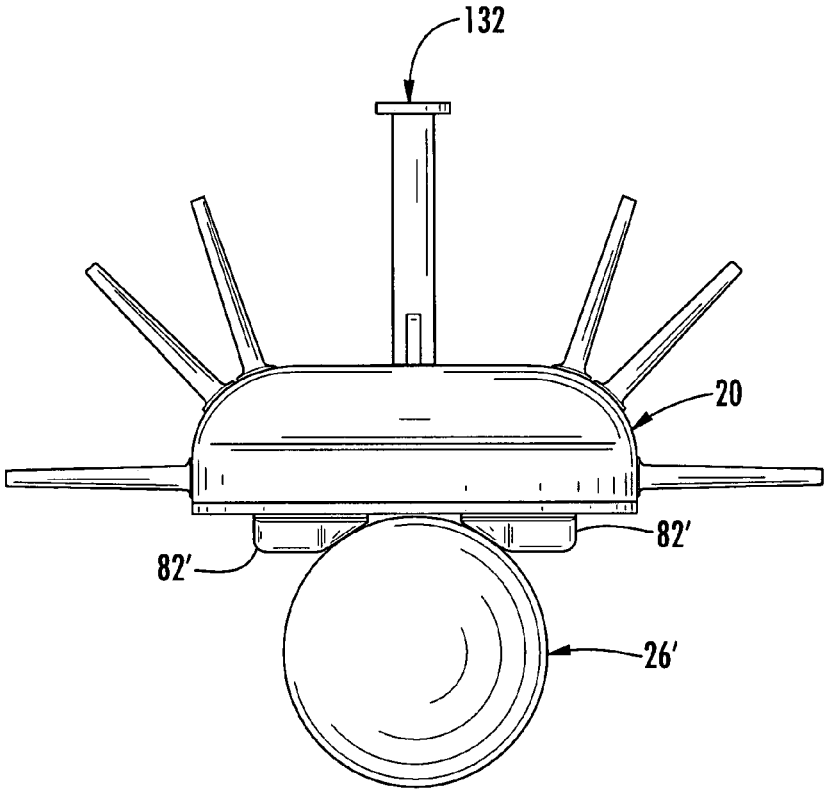
FIG. 25 is a front elevation view of the intercepting vehicle and a different retrievable vehicle in the relatively tightly docked state, in accordance with a second embodiment of the present invention.

In accordance with the first embodiment of the present invention, the docking apparatus 120 (e.g., see FIG. 11) can be retrofitably mounted to a wide variety of retrievable vehicles, such as by modifying the shape of its mounting base 134, and the mounting base may be omitted such that the docking pole 132 is mounted directly to the retrievable vehicle. In addition and as mentioned above, the pads 82 mounted to the bottom of the intercepting vehicle 20 are optional, and they may be omitted or replaced with a variety of differently shaped and/or sized pads 82 for allowing the intercepting vehicle 20 to be securely docked to a wide variety of differently sized and/or shaped retrievable vehicles 26. A couple of examples are shown in FIGS. 25-27, in accordance with second and third embodiments of the present invention.

The second and third embodiments of the present invention are like the first embodiment of the present invention, except for variations noted herein and variations that will be apparent to one of ordinary skill in the art. FIG. 25 is a front elevation view of the intercepting vehicle 20, which has alternative pads 82' mounted thereto, and a different retrievable vehicle 26' (e.g., an autonomous unmanned underwater vehicle) in the relatively tightly docked state, in accordance with the second embodiment of the present invention.

Figure 26:
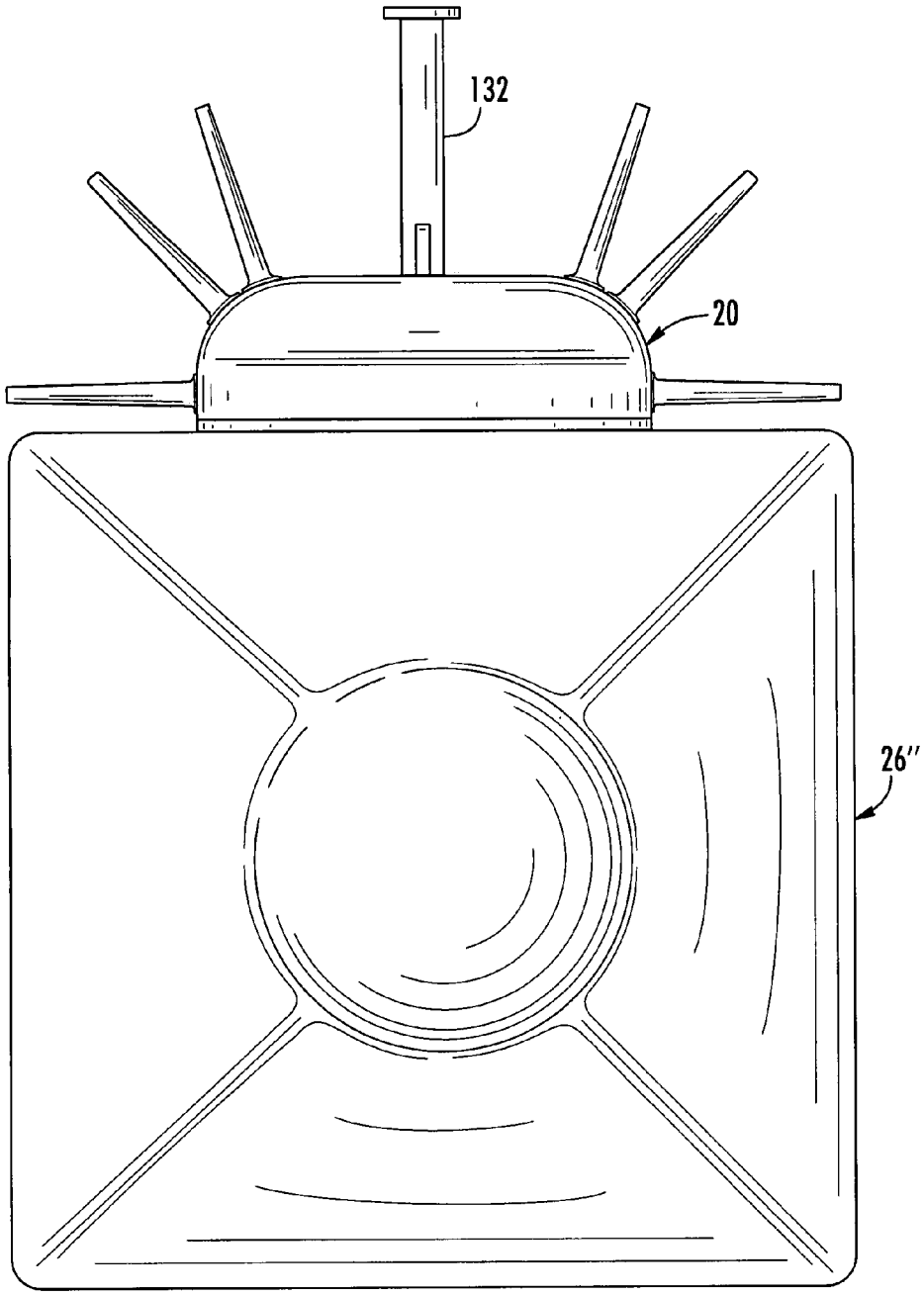
FIG. 26 is a front elevation view of the intercepting vehicle and a different retrievable vehicle in the relatively tightly docked state, in accordance with a third embodiment of the present invention.
Figure 27:
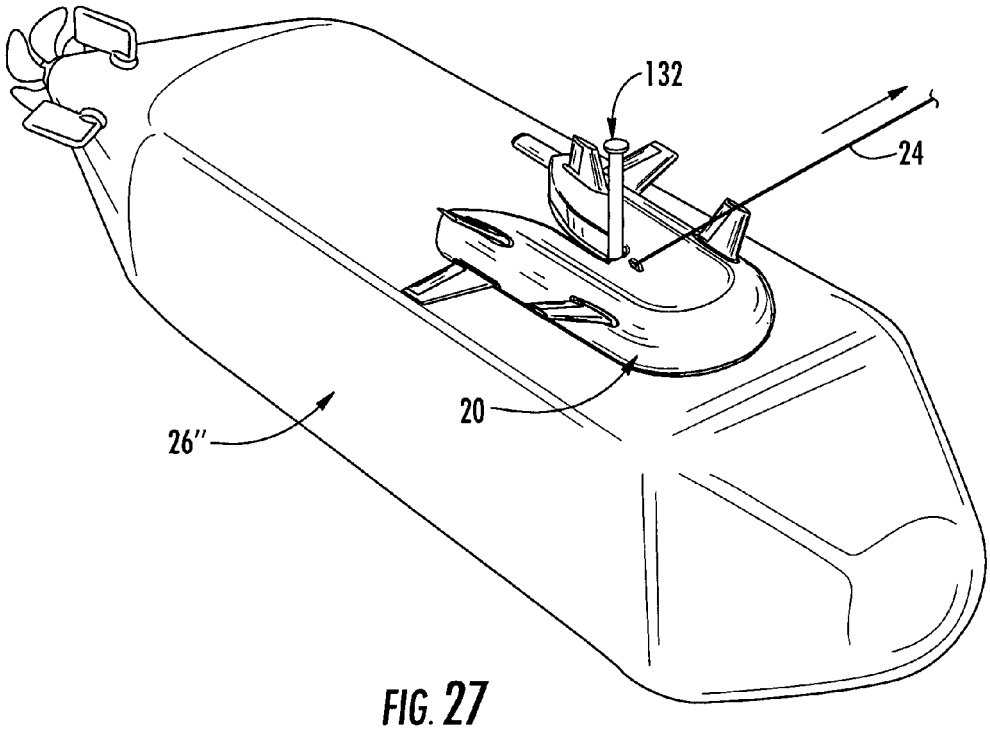
FIG. 27 is a schematic, perspective view of the retrievable vehicle and the intercepting vehicle in the relatively tightly docked state of FIG. 26, and it is schematically shown that the retrievable vehicle and the intercepting vehicle are being retrieved/reeled in by way of the tow line, in accordance with an exemplary method of the third embodiment of the present invention.

FIG. 26 is a front elevation view of the intercepting vehicle 20, without either type of pads 82, 82', and a different retrievable vehicle 26" (e.g., an autonomous unmanned underwater vehicle) in the relatively tightly docked state, in accordance with the third embodiment of the present invention. FIG. 27 is a schematic perspective view of the retrievable vehicle 26" and the intercepting vehicle 20 in the relatively tightly docked state of FIG. 26, and it is schematically shown that the retrievable vehicle and the intercepting vehicle are being retrieved/reeled in by way of the tow line 24, in accordance with an exemplary method of the third embodiment of the present invention. As apparent from FIGS. 26 and 27, the retrievable vehicle 26" has rectangular, or more specifically square, cross sections such that the retrievable vehicle 26" has a planar top surface that is in secure opposing face-to-face contact with the planar, flat bottom surface of intercepting vehicle 20. That is, the planar top surface of the retrievable vehicle 26" is substantially parallel to the planar bottom surface of intercepting vehicle 20.

As mentioned above in accordance with the first embodiment of the present invention, typically one or more of the operational components 96*a-n* of the intercepting vehicle 20 is a computer, and typically one or more of the operational components 162*a-n* of the towing vehicle 22 is a computer. These computers (which include appropriate input and output devices, a processor, memory, etc.) may respectively automatically control the operation of, or aspects of the operation of, the intercepting vehicle 20 and the towing vehicle 22 by virtue of receiving data from and/or providing data (e.g., instructions from the execution of software stored in memory) to respective components. For this purpose and in accordance with the first embodiment of the present invention, each of the computers typically includes or are otherwise associated with one or more computer-readable mediums (e.g., volatile memory and/or nonvolatile memory and/or one or more other storage devices such as, but not limited to, tapes and hard disks such as floppy disks and compact disks) having computer-executable instructions (e.g., one or more software modules or the like), with the computer handling (e.g., processing) the data in the manner indicated by the computer-executable instructions. Accordingly, the computers can be characterized as being schematically illustrative of the computer-readable mediums, computer-executable instructions and other features of methods and systems of the exemplary embodiments of the present invention.

Although the intercepting, towing and the retrievable vehicles 20, 22, 26, 26', 26" have at times been identified in the foregoing as being water vehicles, it is within the scope of the present invention for the intercepting, towing and retrievable vehicles to be other types of vehicles, such as, but not limited to, aircrafts. Accordingly and for example, the above-discussed features (e.g., sonars) that have been described above in the context of water vehicles would be modified accordingly (e.g., to be radars) when the intercepting, towing and retrievable vehicles are aircrafts.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. An intercepting vehicle for use in retrieving a retrievable vehicle, the intercepting vehicle comprising:

a body having opposite first and second sides;

a steering mechanism carried by the body for steering the intercepting vehicle;

a controller for controlling the steering mechanism to substantially align the intercepting vehicle with the retrievable vehicle;

a receptacle hole carried by the body for receiving at least a portion of the retrievable vehicle, wherein the receptacle hole extends through the body, from the first side to the second side, such that the receptacle hole is open at each of the first and second sides;

at least one latch mounted to the body for connecting the retrievable vehicle to the intercepting vehicle in response to the receptacle hole receiving at least the portion of the retrievable vehicle; and pads, wherein the second side of the body is a bottom side of the body, and the pads are mounted to the bottom side and respectively positioned on opposite sides of the receptacle hole.

2. An intercepting vehicle for use in retrieving a retrievable vehicle, the intercepting vehicle comprising:

a body having opposite first and second sides, wherein the body comprises a shell mounted to a metal plate, the metal plate at least partially defines the first side of the body, and the shell at least partially defines the second side of the body;

a steering mechanism carried by the body for steering the intercepting vehicle;

a controller for controlling the steering mechanism to substantially align the intercepting vehicle with the retrievable vehicle;

a receptacle hole carried by the body for receiving at least a portion of the retrievable vehicle, wherein the receptacle hole extends through the body, from the first side to the second side, such that the receptacle hole is open at each of the first and second sides, and wherein the receptacle hole extends through both the shell and the metal plate; and at least one latch mounted to the body for connecting the retrievable vehicle to the intercepting vehicle in response to the receptacle hole receiving at least the portion of the retrievable vehicle.

3. An intercepting vehicle for use in retrieving a retrievable vehicle, the intercepting vehicle comprising:

a body having a top side and a bottom side that is opposite from the top side, wherein the body further includes a front end and a rear end that is opposite from the front end;

a steering mechanism carried by the body for steering the intercepting vehicle;

a controller for controlling the steering mechanism to substantially align the intercepting vehicle with the retrievable vehicle;

a receptacle hole carried by the body for receiving at least a portion of the retrievable vehicle, wherein the receptacle hole extends through the body, from the top side of the body to the bottom side of the body, such that the receptacle hole is open at each of the top and bottom sides of the body, and the receptacle hole is also open at the rear end of the body; and at least one latch mounted to the body for connecting the retrievable vehicle to the intercepting vehicle in response to the receptacle hole receiving at least the portion of the retrievable vehicle.

4. An intercepting vehicle for use in retrieving a retrievable vehicle, the intercepting vehicle comprising:

a body having a top side and a bottom side that is opposite from the top side, and a front end and a rear end that is opposite from the front end, wherein the front and rear ends of the body are spaced apart from one another in a longitudinal direction;

a steering mechanism carried by the body for steering the intercepting vehicle;

a controller for controlling the steering mechanism to substantially align the intercepting vehicle with the retrievable vehicle;

a receptacle hole carried by the body for receiving at least a portion of the retrievable vehicle, wherein the receptacle hole extends through the body, from the top side of the body to the bottom side of the body, such that the receptacle hole is open at each of the top and bottom sides of the body, the receptacle hole is an elongate slot that extends in the longitudinal direction, the slot has a length that extends in the longitudinal direction, the slot has a width that extends crosswise with respect to the longitudinal direction, the width is smaller than the length, and the width becomes larger toward the rear end of the body; and at least one latch mounted to the body for connecting the retrievable vehicle to the intercepting vehicle in response to the receptacle hole receiving at least the portion of the retrievable vehicle.

5. An intercepting vehicle for use in retrieving a retrievable vehicle, the intercepting vehicle comprising:

a body having opposite first and second sides;

a steering mechanism carried by the body for steering the intercepting vehicle;

a receptacle hole carried by the body for receiving at least a portion of the retrievable vehicle, wherein the receptacle hole extends through the body, from the first side to the second side, such that the receptacle hole is open at each of the first and second sides;

at least one latch mounted to the body for connecting the retrievable vehicle to the intercepting vehicle in response to the receptacle hole receiving at least the portion of the retrievable vehicle, wherein the latch has a partially closed configuration, the latch has a further closed configuration, the latch has an opened configuration, and the intercepting vehicle further comprises one or more sensors for at least indirectly detecting when the latch is in the partially closed configuration, and at least indirectly detecting when the latch is in the further closed configuration; and a controller for controlling the steering mechanism to substantially align the intercepting vehicle with the retrievable vehicle, wherein the controller is operative, in response to receiving an indication from the one or more sensors that the latch is in the partially closed configuration, for controlling the steering mechanism so that the intercepting vehicle operates in a descent mode in which the intercepting vehicle descends in a predetermined manner, and the controller is operative, in response to receiving an indication from the one or more sensors that the latch is in the further closed configuration, for controlling the steering mechanism so that the intercepting vehicle ceases to operates in the descent mode.

6. An intercepting vehicle for use in retrieving a retrievable vehicle, the intercepting vehicle comprising:

a body having a top side and a bottom side that is opposite from the top side, a front end and a rear end that is opposite from the front end, wherein the front and rear ends of the body are spaced apart from one another in a longitudinal direction, and an attachment mechanism for being attached to a tow line, wherein the intercepting vehicle is adapted for being towed by a tow line;

a steering mechanism carried by the body for steering the intercepting vehicle, wherein the steering mechanism includes a plurality of fins mounted to the body and projecting outwardly from the body;

a plurality of operational components mounted in an interior of the body, wherein the plurality of operational components includes a controller for controlling the steering mechanism to substantially align the intercepting vehicle with the retrievable vehicle;

a receptacle slot defined by the body for receiving at least a portion of the retrievable vehicle in response to both the intercepting vehicle being substantially aligned with the retrievable vehicle and the retrievable vehicle catching up to the intercepting vehicle from behind the intercepting vehicle, wherein the receptacle slot is open at the rear end of the body and extends in the longitudinal direction forwardly toward the front end of the body, the receptacle slot extends through the body, from the top side of the body to the bottom side of the body, such that the receptacle hole is also open at each of the top and bottom sides of the body, the receptacle slot has a width that extends crosswise with respect to the longitudinal direction, and the width becomes larger toward the rear end of the body, and the receptacle slot is positioned between and extends forwardly of at least two of the fins so that the two fins are respectively positioned on opposite sides of the receptacle slot; and at least one latch mounted to the body for connecting the retrievable vehicle to the intercepting vehicle in response to the receptacle hole receiving at least the portion of the retrievable vehicle, wherein the latch is positioned along and proximate the receptacle slot, and between the rear end of the body and the attachment mechanism.

7. The intercepting vehicle according to claim 6, wherein the intercepting vehicle is an unmanned underwater vehicle.

8. The intercepting vehicle according to claim 3, wherein the steering mechanism comprises a plurality of fins mounted to the body and projecting outwardly from the body, wherein the receptacle hole is positioned between at least two of the fins so that the two fins are respectively positioned on opposite sides of the receptacle hole.

9. The intercepting vehicle according to claim 4, wherein the receptacle hole comprises a slot that extends inwardly from a peripheral portion of the rear end of the body, and the slot is open at the peripheral portion of the rear end of the body.

10. The intercepting vehicle according to claim 3, wherein the body further includes a flange that extends at least partially around, and protrudes into, the receptacle hole.

11. The intercepting vehicle according to claim 10, wherein the flange is proximate the bottom side.

12. The intercepting vehicle according to claim 3, further comprising:

at least one a transmitter for transmitting acoustic signals, wherein the transmitter is carried by the body; and at least one receiver for receiving acoustic signals, wherein the receptacle hole divides the rear end into a right side of the rear end and a left side of the rear end, whereby the receptacle hole is positioned between and separates the right and left sides of the rear end from one another, and the receiver is mounted to the right side of the rear end or the left side of the rear end.

13. The intercepting vehicle according to claim 3, wherein the steering mechanism comprises a plurality of fins for being mounted to the body and projecting outwardly from the body.

14. The intercepting vehicle according to claim 13, wherein at least one fin of the plurality of fins is for being mounted proximate the front end of the body.

15. The intercepting vehicle according to claim 13, wherein:

the bottom side of the body defines a plane; and none of the fins extend below the plane while the fins are mounted to the body.

16. The intercepting vehicle according to claim 13, wherein:

the body includes a plurality of mounting regions that are adapted for having the plurality of fins respectively mounted thereto;

each of the mounting regions is adapted for having any one of the plurality of fins mounted thereto; and each of the fins is adapted for being mounted to any one of the plurality of mounting regions.

17. The intercepting vehicle according to claim 13, wherein for each fin of the plurality of fins:

the fin comprises a rudder, and there is a keyed connection between the rudder and an actuator for driving the rudder.

18. The intercepting vehicle according to claim 3, wherein the body comprises an attachment mechanism for being attached to a tow line, wherein the intercepting vehicle is adapted for being towed by a tow line.

19. The intercepting vehicle according to claim 18, wherein the attachment mechanism is positioned:

forwardly of the receptacle hole, and rearwardly of the front end.

20. The intercepting vehicle according to claim 18 in combination with the tow line, wherein:

the tow line is attached to the attachment mechanism, and electrical power is provided to the intercepting vehicle by way of the tow line.

21. The intercepting vehicle according to claim 3, wherein:

the receptacle hole is an elongate slot that extends in a longitudinal direction; and the front and rear ends of the body are spaced apart from one another in the longitudinal direction.

22. The intercepting vehicle according to claim 21, wherein:

the slot has a length that extends in the longitudinal direction, and the slot has a width that extends crosswise with respect to the longitudinal direction, and the width is smaller than the length.

23. The intercepting vehicle according to claim 3, wherein the latch is positioned proximate the receptacle hole.

24. The intercepting vehicle according to claim 23, wherein the latch is proximate an end of the receptacle hole.

25. The intercepting vehicle according to claim 23, wherein the latch extends into the receptacle hole.

26. The intercepting vehicle according to claim 23, wherein:

the latch has a closed configuration, the latch has an opened configuration, and the intercepting vehicle further comprises a sensor for at least indirectly detecting when the latch is in the closed configuration.

27. The intercepting vehicle according to claim 23, wherein:

the latch has a partially closed configuration, the latch has a further closed configuration, the latch has an opened configuration, and the intercepting vehicle further comprises one or more sensors for at least indirectly detecting when the latch is in the partially closed configuration, and at least indirectly detecting when the latch is in the further closed configuration.

28. The intercepting vehicle according to claim 6, wherein:

intercepting vehicle is an unmanned underwater vehicle, and the retrievable vehicle is an unmanned underwater vehicle.

29. The intercepting vehicle according to claim 4, wherein the body comprises an attachment mechanism for being attached to a tow line, wherein the intercepting vehicle is adapted for being towed by a tow line.

30. The intercepting vehicle according to claim 6, wherein the latch extends into the receptacle hole.

31. The intercepting vehicle according to claim 4, wherein:

the steering mechanism comprises fins mounted to the body, with at least portions of the fins being movable for at least partially steering the vehicle; and the controller is for controlling movement of at least portions of the fins.

32. The intercepting vehicle according to claim 6 in combination with a docking apparatus for the retrievable vehicle, wherein:

the docking apparatus comprises a pole having a discontinuity adapted for being latched onto by the latch, the discontinuity is adjacent an end selected from the group consisting of opposite first and second ends of the pole, and the first end of the pole is for mounting to the retrievable vehicle.

33. The combination according to claim 32, further comprising a mounting base attached to the first end of the pole, wherein:

the mounting base is broader than a diameter of the pole, and the mounting base comprises a concave surface that faces away from the pole.

34. The combination according to claim 32, further comprising a beacon mounted to the docking apparatus.

35. The combination according to claim 34, wherein the beacon comprises a transponder.

36. The combination according to claim 32, wherein the discontinuity comprises a shoulder.

37. The combination according to claim 36, wherein the shoulder is annular.

38. The combination according to claim 36, wherein the discontinuity comprises flange that is proximate the second end of the pole and defines the shoulder.

39. The combination according to claim 36, wherein the discontinuity comprises an indentation that is proximate the first end of the pole and defines the shoulder.

40. The intercepting vehicle according to claim 6, wherein the controller is at least partially adapted for causing the intercepting vehicle to home in on the retrievable vehicle.

41. The intercepting vehicle according to claim 40, wherein:

the retrievable vehicle is an unmanned underwater vehicle, and the intercepting vehicle is an unmanned underwater vehicle.

42. The intercepting vehicle according to claim 1, wherein the intercepting vehicle is an unmanned underwater vehicle.

43. The intercepting vehicle according to claim 1, wherein:

the body comprises a shell mounted to a plate, the plate at least partially defines the first side of the body, the shell at least partially defines the second side of the body, the receptacle hole extends through both the shell and the plate, the shell defines a cavity, the intercepting vehicle comprises a plurality of operational components mounted in the cavity, the plurality of operational components includes the controller, so that the controller is mounted in the cavity, and the plate substantially closes the cavity.

44. The intercepting vehicle according to claim 2, wherein the intercepting vehicle is an unmanned underwater vehicle.

45. The intercepting vehicle according to claim 1, wherein:

the shell defines a cavity, the intercepting vehicle comprises a plurality of operational components mounted in the cavity, the plurality of operational components includes the controller, so that the controller is mounted in the cavity, and the metal plate substantially closes the cavity.

46. The intercepting vehicle according to claim 3, wherein the intercepting vehicle is an unmanned underwater vehicle.

47. The intercepting vehicle according to claim 3, wherein:

the body comprises a shell mounted to a plate, the plate at least partially defines the first side of the body, the shell at least partially defines the second side of the body, the receptacle hole extends through both the shell and the plate, the shell defines a cavity, the intercepting vehicle comprises a plurality of operational components mounted in the cavity, the plurality of operational components includes the controller, so that the controller is mounted in the cavity, and the plate substantially closes the cavity.

48. The intercepting vehicle according to claim 4, wherein the intercepting vehicle is an unmanned underwater vehicle.

49. The intercepting vehicle according to claim 4, wherein:

the body comprises a shell mounted to a plate, the plate at least partially defines the first side of the body, the shell at least partially defines the second side of the body, the receptacle hole extends through both the shell and the plate, the shell defines a cavity, the intercepting vehicle comprises a plurality of operational components mounted in the cavity, the plurality of operational components includes the controller, so that the controller is mounted in the cavity, and the plate substantially closes the cavity.

50. The intercepting vehicle according to claim 5, wherein the intercepting vehicle is an unmanned underwater vehicle.

51. The intercepting vehicle according to claim 5, wherein:

the body comprises a shell mounted to a plate, the plate at least partially defines the first side of the body, the shell at least partially defines the second side of the body, the receptacle hole extends through both the shell and the plate, the shell defines a cavity, the intercepting vehicle comprises a plurality of operational components mounted in the cavity, the plurality of operational components includes the controller, so that the controller is mounted in the cavity, and the plate substantially closes the cavity.

52. The intercepting vehicle according to claim 6, wherein the attachment mechanism, which is for being attached to the tow line, is positioned between the front and rear ends of the body.

53. The intercepting vehicle according to claim 6, wherein:

the steering mechanism includes a plurality of actuators mounted in the interior of the body and respectively operatively connected to the fins for controlling movement of at least portions of the fins, and the receptacle slot is positioned between and extends forwardly of at least two of the actuators so that the two actuators are respectively positioned on the opposite sides of the receptacle slot.

54. The intercepting vehicle according to claim 6, comprising the tow line being connected to and extending forwardly from the attachment mechanism.

55. The intercepting vehicle according to claim 6, further comprising pads that are elongate and extend in the longitudinal direction, wherein the pads are mounted to the bottom side, extend along the receptacle slot, and are respectively positioned on opposite sides of the receptacle slot.

56. The intercepting vehicle according to claim 6, wherein:

the body comprises a shell mounted to a plate, the plate at least partially defines the first side of the body, the shell at least partially defines the second side of the body, the receptacle hole extends through both the shell and the plate, the shell defines a cavity, the intercepting vehicle comprises a plurality of operational components mounted in the cavity, the plurality of operational components includes the controller, so that the controller is mounted in the cavity, and the plate substantially closes the cavity.

* * * * *

UNITED STATES PATENT AND TRADEMARK OFFICE

CERTIFICATE OF CORRECTION

PATENT NO. : 8,145,369 B1
APPLICATION NO. : 11/982041
DATED : March 27, 2012
INVENTOR(S) : Tureaud et al.

It is certified that error appears in the above-identified patent and that said Letters Patent is hereby corrected as shown below:

In Claim 45, column 35, line 21, "claim 1" should read -- claim 2 --

Signed and Sealed this
Tenth Day of July, 2012

David J. Kappos

David J. Kappos
*Director of the United States Patent and Trademark Office*